US007357169B2

(12) United States Patent
Vianello et al.

(10) Patent No.: US 7,357,169 B2
(45) Date of Patent: Apr. 15, 2008

(54) AUTOMATIC MACHINE FOR APPLYING A SPACER TAPE MADE OF FLEXIBLE MATERIAL TO FLAT GLASS PANES, PARTICULARLY GLASS PANES FOR MANUFACTURING DOUBLE-GLAZING UNITS

(75) Inventors: Fortunato Vianello, Vallio di Roncade (IT); Dino Moschini, Roncade (IT)

(73) Assignee: For: El. Base Di Vianello Fortunato & C. S.n.c., Vallion Di Roncade (IT)

( * ) Notice: Subject to any disclaimer, the term of this patent is extended or adjusted under 35 U.S.C. 154(b) by 37 days.

(21) Appl. No.: 11/245,132

(22) Filed: Oct. 7, 2005

(65) Prior Publication Data

US 2006/0080915 A1 Apr. 20, 2006

(30) Foreign Application Priority Data

Oct. 20, 2004 (IT) ..... TV2004A0117

(51) Int. Cl.

| | |
|---|---|
| ***B26D 5/02*** | (2006.01) |
| ***B32B 37/14*** | (2006.01) |
| ***B65C 9/40*** | (2006.01) |
| ***G05G 15/00*** | (2006.01) |
| *B32B 38/04* | (2006.01) |
| *G05G 15/06* | (2006.01) |
| *B65C 9/32* | (2006.01) |

(52) U.S. Cl. ..... 156/566; 156/354; 156/443; 156/538

(58) Field of Classification Search ..... 156/212, 156/538, 556, DIG. 39, 184, 190, 162, 169–173, 156/425–432, 443–496, 354

See application file for complete search history.

(56) References Cited

U.S. PATENT DOCUMENTS 4,354,817 A * 10/1982 Gilman ..... 425/331
4,467,973 A * 8/1984 Iwata ..... 242/437.1
4,534,817 A * 8/1985 O'Sullivan ..... 156/352

(Continued)

FOREIGN PATENT DOCUMENTS

EP 0 770 754 A1 5/1997

(Continued)

*Primary Examiner*—Philip C. Tucker
*Assistant Examiner*—Sonya Mazumdar
(74) *Attorney, Agent, or Firm*—Modiano & Associati; Albert Josif; Daniel J. O'Byrne

(57) ABSTRACT

An automatic machine for applying a flexible tape on a substantially flat glass pane, comprising a machine body in which there is a plane for the substantially vertical arrangement of at least one substantially flat glass pane, a carriage with which a head for applying a flexible tape along the perimetric edge of the glass pane is associated, and tape feeder means rigidly coupled to the application head, the glass pane and the carriage being mutually movable with a translational motion along at least one first axis and one second axis, which are mutually substantially perpendicular and parallel to the plane of arrangement. The carriage further comprises means for supporting at least one spool for storing the tape, which is supported so that it can rotate about its own longitudinal axis, and the application head is associated with the carriage so that it can rotate about a third axis, which is substantially perpendicular to the plane of arrangement, the supporting means and the application head being rigidly coupled to the carriage in its relative translational motions with respect to the glass pane along the first and second axes, and the supporting means being independent of the application head in its rotary motion about the third axis.

27 Claims, 18 Drawing Sheets

U.S. PATENT DOCUMENTS

| | | | | | |
|---|---|---|---|---|---|
| 4,708,762 | A | * | 11/1987 | Lenhardt | 156/556 |
| 4,743,336 | A | * | 5/1988 | White | 156/522 |
| 5,238,515 | A | * | 8/1993 | Insalaco et al. | 156/201 |
| 5,888,341 | A | * | 3/1999 | Lafond | 156/468 |
| 6,544,367 | B1 | * | 4/2003 | Fujimoto et al. | 156/187 |

FOREIGN PATENT DOCUMENTS

| | | | | |
|---|---|---|---|---|
| FR | 2 590 312 | A | | 5/1987 |
| JP | 2003338527 | A | * | 11/2003 |

* cited by examiner 410
403a
403b
405
405
1b
406
1a
401b
404
402a
400'
401a
400

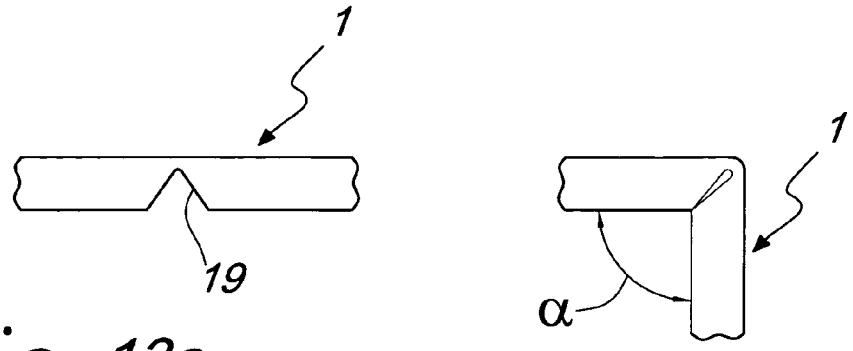
Fig. 13a
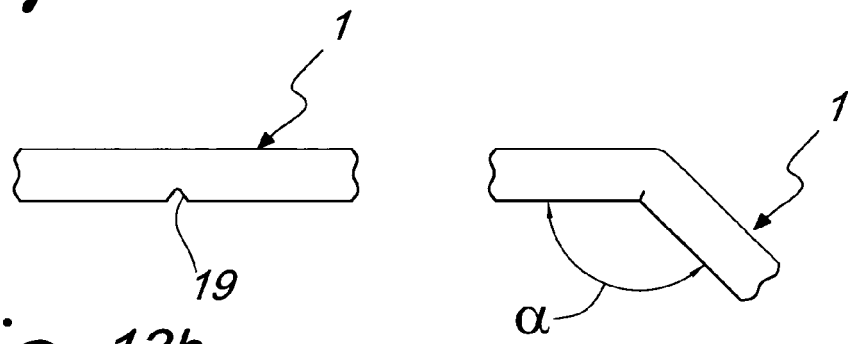
Fig. 13b
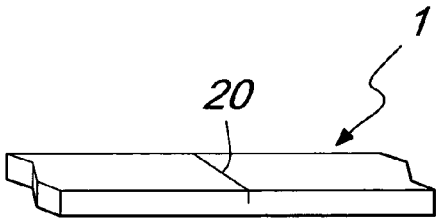
Fig. 13c
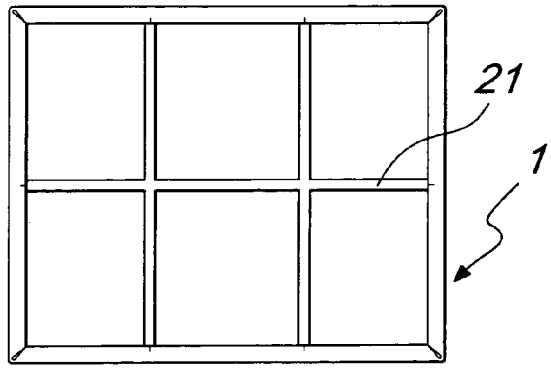
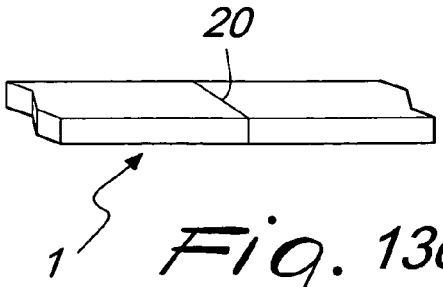
Fig. 13d
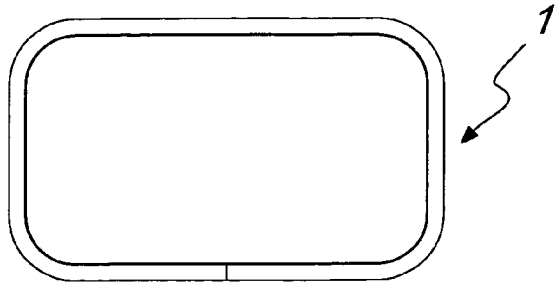

AUTOMATIC MACHINE FOR APPLYING A SPACER TAPE MADE OF FLEXIBLE MATERIAL TO FLAT GLASS PANES, PARTICULARLY GLASS PANES FOR MANUFACTURING DOUBLE-GLAZING UNITS

The present invention relates to an automatic machine for applying a spacer tape made of flexible material to flat sheets, particularly glass panes for manufacturing double-glazing units.

BACKGROUND OF THE INVENTION

It is known that a double-glazing unit is constituted by two or more substantially flat glass panes, which are arranged substantially parallel to each other and are mutually spaced; the sheets of each pair of consecutive panes are mutually coupled by interposing a spacer profile, which is distributed along their entire perimeter.

In general, a double-glazing unit can be constituted by a plurality of glass panes, which are coupled in pairs by interposing a respective spacer profile; merely by way of example, double-glazing units are known which are constituted by two glass panes which are mutually coupled by interposing a spacer profile, or by three glass panes, which are coupled in pairs by interposing a respective spacer profile.

In order to better understand the configuration of a glass pane, not so much in its separate use, but rather in its use in combination with other components, including in particular the spacer profile for forming the double-glazing unit, some concepts which relate both to the intermediate products, i.e., to the glass panes and the spacer profiles, and to the finished product, i.e., the double-glazing unit, are summarized hereafter. The subsequent use of the double-glazing unit as a component of a door or window is known to the person skilled in the art and therefore is not discussed here in detail.

With reference to FIG. 1, the double-glazing unit 3 is constituted by the coupling of two or more substantially flat glass panes 2, which are mutually parallel and spaced; the two panes 2 of each pair of consecutive sheets are mutually separated by interposing a respective spacer profile, which can be constituted either by a tape 1 made of flexible material or, as an alternative, by a frame 1', both of which are described in greater detail hereinafter.

FIG. 1 illustrates five possible sectional views of configurations of the double-glazing unit 3: 1A, 1B, 1C, 1D and 1E; these configurations differ from each other in the composition of the double-glazing unit 3, in the type of spacer profile and in the configuration and relative arrangement of the glass panes 2. In particular, in configurations 1A-1C, the spacer profile is constituted by a frame 1', while in configurations 1D and 1E said profile is constituted by a tape 1.

The chamber 4 delimited by each pair of glass panes 2 and by the respective spacer profile may contain air or can be filled advantageously with a gas or mixture of gases injected therein, giving the double-glazing unit 3 particular insulation properties, for example thermally-insulating and/or soundproofing properties. The coupling between each pair of glass panes 2 and the respective spacer profile is achieved by means of two seals: a first seal 5, which is intended to provide the initial coupling of the glass panes 2 and of the spacer profile and the hermetic closure of the chamber 4 formed between them, and a second seal 6, which is intended to consolidate the coupling between the two glass panes 2 and the respective spacer profile and to give mechanical strength to the coupling formed between them.

The first seal 5 affects the lateral surfaces of the spacer profile in contact with the two glass panes 2 and the corresponding portions of the faces of the glass panes 2 which face each other.

The second seal 6 affects the compartment formed by the face of the spacer profile that is directed toward the outside of the chamber 4 and by the portions of the faces of the glass panes 2 which face each other and protrude from the outer face of the spacer profile up to the perimetric edge of said glass panes 2.

The glass panes 2 used to compose the double-glazing unit 3 can have a different configuration depending on their different use, for example depending on the fact that the glass pane 2 is used for the side of the double-glazing unit 3 that is directed toward the outside of the building or of the space closed by the corresponding door or window or toward its inside; in FIG. 1, the inside and the outside of the space enclosed by the double-glazing unit 3 are represented schematically by a sun and by a radiator. The glass pane 2 used for the outer side can be for example of the normal or reflective type, in order to limit the heat input in summer months, or can be of the laminated/bulletproof type, with an intrusion-resistant and/or vandalism-resistant function, or of the laminated/tempered type, with a safety function, or also of a combined type, for example reflective and laminated. The glass pane 2 used for the internal side can instead be of the normal or low-emissivity type, in order to limit the loss of heat in winter months, or can be of the laminated/tempered type with safety functions, or of a combined type, for example of the low-emissivity and laminated type.

As mentioned, the spacer profile can be constituted by a substantially rigid frame 1', which is made for example of aluminum, steel or plastics, is internally hollow, and has small perforations in the face directed toward the inside of the chamber 4 of the double-glazing unit 3 (FIG. 1, configurations 1A-1C). The cavity 7 inside the frame 1' is generally filled with hygroscopic material, which is not shown. The frame 1' is an intermediate product used in the production line of the double-glazing unit; it is preformed with shapes and dimensions which correspond to those of the glass panes 2 with which it is to be coupled. If the spacer profile is constituted by a frame 1', the first seal 5 is constituted by a thermoplastic sealant, for example a butyl sealant, which is spread over its lateral surfaces before it is applied to the glass panes 2, while the second seal 6 is constituted by a sealant, for example of the polysulfide, polyurethane or silicone type. The application of the frame 1' to the glass panes 2 has drawbacks: in particular, the sealant of the first seal 5 tends to creep until the sealant of the second seal 6 has catalyzed completely.

As an alternative, the spacer profile can be constituted by a tape 1 made of expanded synthetic material of the flexible type, such as, merely by way of example, silicone or EPDM, which incorporates the hygroscopic material within its mass. The tape 1, a portion of which is shown in FIG. 2, has a substantially rectangular cross-section and can have different dimensions; the two opposite lateral surfaces of the tape 1, which are designed to make contact with the faces of the two glass panes 2 between which it is interposed, are coated with an adhesive 8, for example of the acrylic type, and are covered temporarily by a respective protective film 1*a* and 1*b*, which is removed when the tape 1 is applied to the glass panes 2. If the spacer profile is constituted by the tape 1, the first seal 5 is provided by the adhesive 8 itself, while the second seal 6 is constituted by a sealant, for example of the butyl type. The tape 1 is an intermediate product, which is supplied wound on spools from which it is gradually unwound in order to be applied to the glass panes 2 along a double-glazing unit production line.

In recent years, the use of the tape 1 as a spacer profile in replacement of the conventional frame 1' has become particularly widespread; said tape has some advantages with respect to said frame: it has a lower heat transmission coefficient than the frame 1', it adheres practically immediately and stably to the glass panes 2, since the adhesive 8 is not subject to the creep which is typical of thermoplastic sealants used for frames 1', and it is versatile and flexible in use. It in fact allows to follow the perimeter of glass panes of any shape and size, being "shaped/contoured" simultaneously with its application thereto and without requiring, differently from the frame 1', to be preformed and contoured with definite shapes and dimensions which match those of the glass panes 2 to which it is to be applied.

From what has been described it is evident that a double-glazing unit production line provides a plurality of successive treatments, including in particular the application of the spacer profile, each treatment being performed by a respective automatic or semiautomatic machine in a station of the line that is dedicated thereto.

Merely by way of non-limiting example, the processes which are possible but not all always necessary and are provided along a double-glazing unit production line are the following:

- removing, on the peripheral face of the glass panes, of any coatings, in order to maintain over time the adhesive bonding of the first and second seals;
- beveling the sharp edges of the glass panes, both to eliminate defects arising from the cut and for safety reasons, in order to reduce the risk of injury in the handling of the individual panes and of the double-glazing unit;
- washing the individual panes, alternating an inside pane and an outside pane, the internal or external orientation being the one defined earlier;
- applying the spacer profile, constituted either by a rigid frame, which is preformed in the machine which is external to the double-glazing unit production line, or by a tape made of a flexible material wound on a spool. In the first case, a thermoplastic sealant is spread beforehand on the opposite lateral surfaces of the preformed frame; in the second case, the tape is unwound from the spool and, after removing the protective films from its opposite lateral surfaces, it is shaped so as to constitute a closed profile along the entire perimeter of the glass pane simultaneously with its application thereon;
- coupling and pressing the assembly formed by the glass panes and the spacer profile or spacer profiles;
- filling the resulting chamber or chambers with gas;
- second sealing.

With particular reference to the application of the spacer profile constituted by a tape made of flexible material, automatic machines for manufacturing it are known and are for example the subject of US2003/0178127 and EP-A-0770755.

US2003/0178127 discloses an automatic machine for applying an elastoplastic spacer tape, which comprises substantially a surface for supporting a glass pane which lies slightly inclined with respect to the vertical, a horizontal conveyor located proximate to the lower edge of the supporting surface, and a post which is arranged on a plane which is substantially parallel to the supporting surface and along which an application head is supported movably, said head being able to rotate about an axis which is substantially perpendicular to the supporting surface. The application head rigidly supports means for feeding the tape to be applied, which are provided with a section for compensating the length of tape that is fed, said means being suitable to avoid the onset of abnormal slackening or tensions of said tape. The fed tape is unwound from a motorized storage spool, which is located remotely with respect to the application head, i.e., the spool is arranged in a feeder station located proximate to the machine. The portion of tape unwound from the spool which runs from the feeder station to the feeder means rigidly coupled to the application head can be guided along a predefined path, which is flexible and whose length can vary depending on the movements of the application head.

However, this machine has drawbacks, including the fact that despite the presence of the compensation section rigidly coupled to the application head, the portion of tape that runs along the path from the feeder station to the application head is subjected to traction and/or shearing tensions, or to abnormal slackenings, which cause application defects, such as shrinkages or undulations, which due to the elastoplasticity of the material that constitutes the tape may also become apparent over time. The length of the path that leads from the feeder station to the application head is in fact not only considerable but also variable over time due to the translational and rotary motions of the application head, and this prevents precision control of the state of the stresses to which the tape is subjected along said path.

Another drawback is that the feeder station and the guiding path that leads the tape from the feeder station to the application head have significant dimensions and installation, management and maintenance costs.

Another drawback is constituted by the fact that the operations for replacing the spool of tape, both when the preceding spool is depleted and when it is necessary to use a different type of tape, are laborious and require long execution times, which slow down production; it is in fact necessary to insert the portion of tape that runs from the feeder station to the application head along the corresponding guiding path.

EP-A-0770755 discloses an automatic machine for applying a tape made of flexible material, particularly a thermoplastic tape reinforced with a metal core, which is constituted substantially by a robotized manipulation arm which works according to a system of Cartesian coordinates.

The manipulation arm has an end which is associated with a supporting base and an opposite end with which a tape application head is associated, said head rigidly supporting a cradle for supporting a motorized tape feeder spool. In particular, the manipulation arm is of the type with at least six axes and can move the application head with a translational motion and/or a rotary motion with respect to axes which are parallel and perpendicular to the plane of arrangement of the glass pane, so as to be able to follow its perimeter continuously. The arm works on a glass pane which is arranged on a substantially horizontal supporting surface; the arm moves the application head with respect to the glass pane, which is kept stationary, so as to apply the tape along its entire perimeter. To form corners or follow arc-like portions of the perimeter of the glass pane, the arm turns through a corresponding angle the application head, the motorized spool rotating rigidly with the head.

This machine also, however, has drawbacks, including the fact that it provides inaccurate, defective and low-quality comers and arc-like profiles, due to the inertial effects and oscillations caused by the rotation of the spool and of the corresponding motor rigidly with the application head.

In order to obviate this drawback and improve the quality of the comers and arc-like profiles, it is possible to oversize the manipulation arm, but this entails both a disadvantageous increase in production, installation and management costs and a disadvantageous increase in space occupation and maneuvering spaces.

As an alternative, it is possible to slow the movements, particularly the rotary movements, of the application head, but this entails a disadvantageous slowing of production.

SUMMARY OF THE INVENTION

The aim of the present invention is therefore to solve the described technical problems, eliminating all the drawbacks of the background art by means of an automatic machine which allows to apply to a glass pane a spacer profile shaped like a tape of flexible material in a manner which is cheap, functional and reliable, and to provide comers or arc-like profiles of a higher quality than achievable with known machines.

Within this aim, an object of the present invention is to provide an automatic machine which is compact and can be inserted easily along a double-glazing unit production line without altering its typically modular structure.

Another object is to provide an automatic machine which allows to control precisely the state of the stresses to which the tape is subjected, preventing its application when tensioned or slack.

Another object is to provide an automatic machine which allows to apply the tape precisely also at comers and/or arc-like profiles, eliminating the formation of defects thereat.

Another object is to provide an automatic machine which allows to cut or score the tape to provide corners, joints or notches for the insertion of frames precisely depending on the various shapes that the perimeter of the glass panes can assume.

Another object is to provide an automatic machine which allows to change the tape storage spool simply and rapidly.

Another object is to provide an automatic machine which has a low cost and allows to maintain a high production rate both in qualitative terms and in quantitative terms.

This aim and these and other objects, which will become better apparent from the description that follows, are achieved by an automatic machine for applying a flexible tape on a substantially flat glass pane, which comprises a machine body which has a plane for the substantially vertical arrangement of at least one substantially flat glass pane, a carriage with which a head for applying a flexible tape along the perimetric edge of the glass pane is associated, and tape feeder means rigidly coupled to the application head, the glass pane and the carriage being mutually movable with a translational motion along at least one first axis and one second axis, which are mutually substantially perpendicular and parallel to the plane of arrangement of the glass pane, and characterized in that the carriage comprises means for supporting at least one tape storage spool, which is supported so that it can rotate about its own longitudinal axis, and in that the application head is associated, so that it can rotate about a third axis, which is substantially perpendicular to the plane of arrangement of the glass pane, with the carriage, the supporting means and the application head being rigidly coupled to the carriage in its relative translational motions with respect to the glass pane along the first and second axes, and the supporting means being independent of the application head in its rotary motion about the third axis.

BRIEF DESCRIPTION OF THE DRAWINGS

Further characteristics and advantages of the invention will become better apparent from the following detailed description of a particular embodiment thereof, illustrated merely by way of non-limiting example in the accompanying drawings, wherein:

FIGS. 13*a*-13*d* illustrate various configurations for scoring or cutting the tape and the corresponding application configurations;

DESCRIPTION OF THE PREFERRED EMBODIMENTS

With reference to the accompanying figures, single-digit numerals are used to designate the materials being worked, such as the flat glass pane and the flexible tape; two-digit numerals are used to designate the completion components of the machine according to the invention, such as the electrical or electronic control panel or control booth; and three-digit numerals designate the main assemblies of the machine, each assembly being identified by a numeral composed of an initial digit followed by two zeros, while the components and details of each assembly are identified by a numeral in which the initial digit corresponds to the digit of the corresponding group and the other two digits distinguish it from the others.

Four-digit numerals are used to identify the machine as a whole and the machines arranged upstream and downstream thereof along a double-glazing unit production line of a known type.

Figure 4:
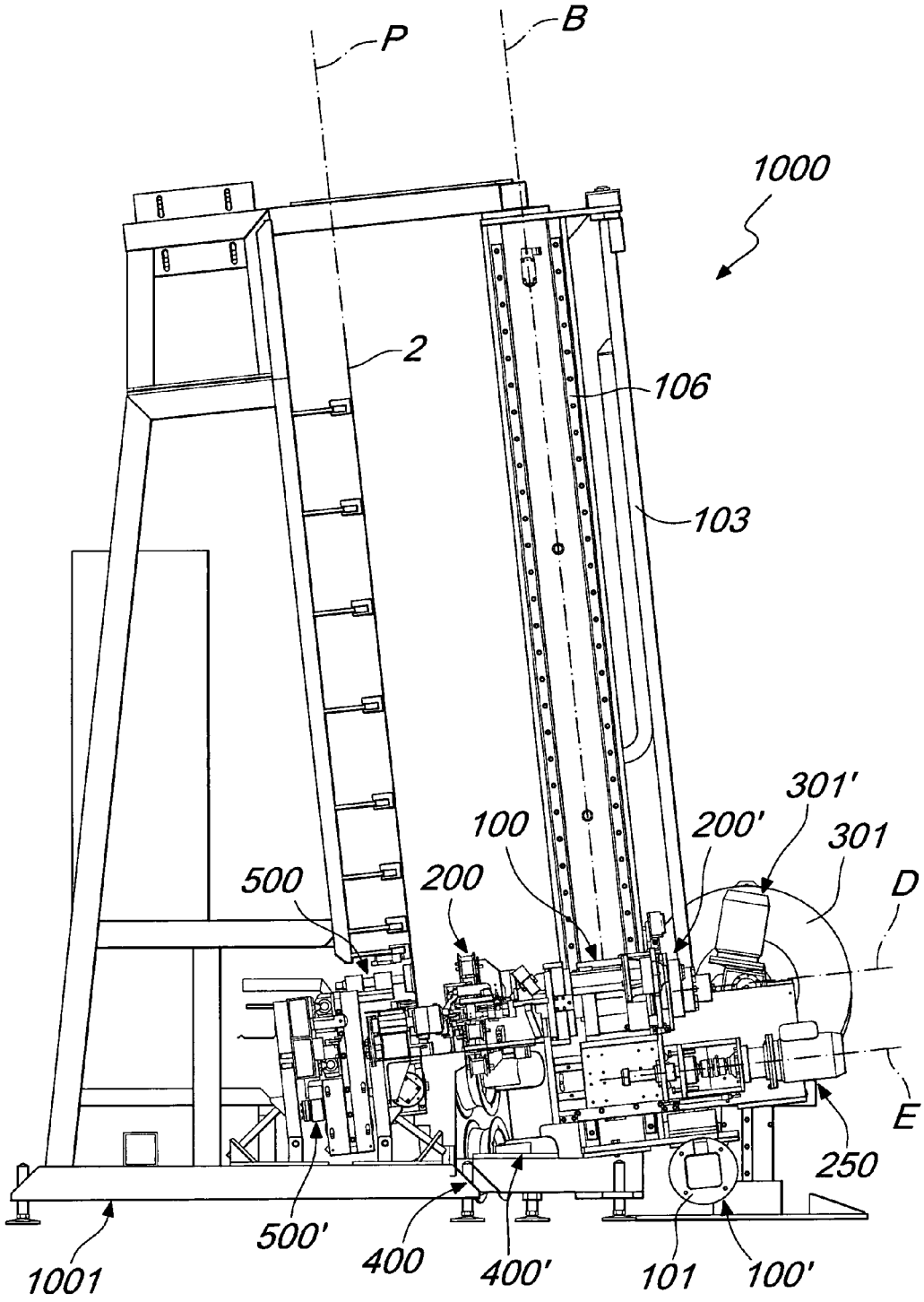
FIG. 4 is a general side view of the machine according to the invention.
Figure 4A:
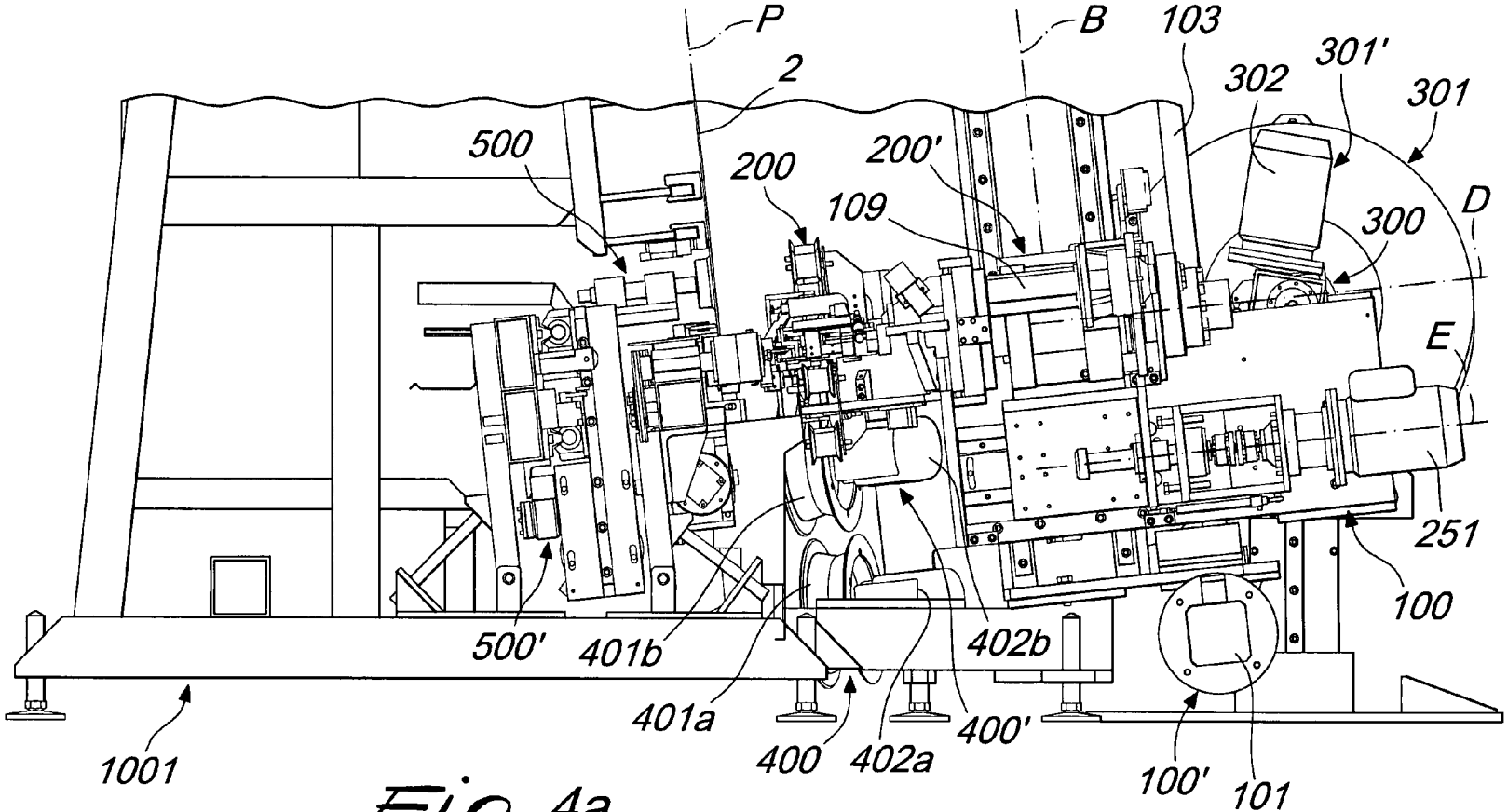
FIG. 4*a* is an enlarged-scale view of a detail of FIG. 4.
Figure 5:
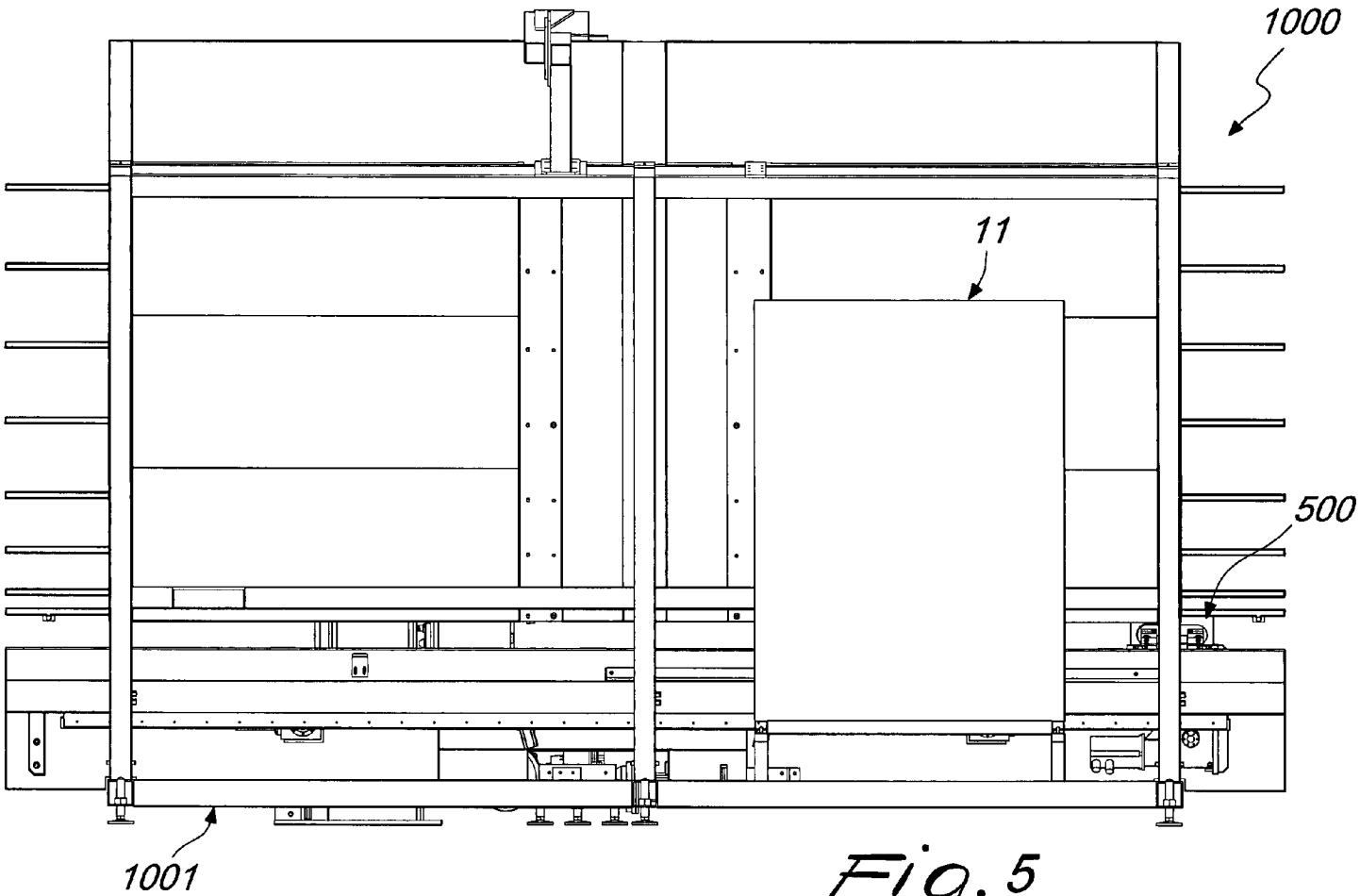
FIG. 5 is a general rear view of the machine according to the invention.

In the description that follows, when the term "vertical" is used with reference to the machine, a substantially vertical orientation is intended, i.e., an orientation which is slightly inclined with respect to the direction which is perpendicular to the supporting surface of the machine. Likewise, when the term "horizontal" is used with reference to the machine, it is used to intend a substantially horizontal orientation, i.e., one which is slightly inclined with respect to the horizontal plane which is parallel to the machine supporting surface. It is in fact known that flat glass panes are conveyed along a production line for double-glazing units on conveyors which form a plane of arrangement for the pane and a supporting surface for its lower edge which are inclined by approximately 6° respectively relative to the vertical plane and to the horizontal plane thus defined with respect to the supporting surface of the machine, as shown in FIGS. 4 and 4*a*.

The machine 1000 according to the invention is an automatic machine for applying a tape 1 made of flexible material along the perimeter of a substantially flat glass pane 2, particularly a glass pane 2 made for producing a double-glazing unit 3.

Figure 1:
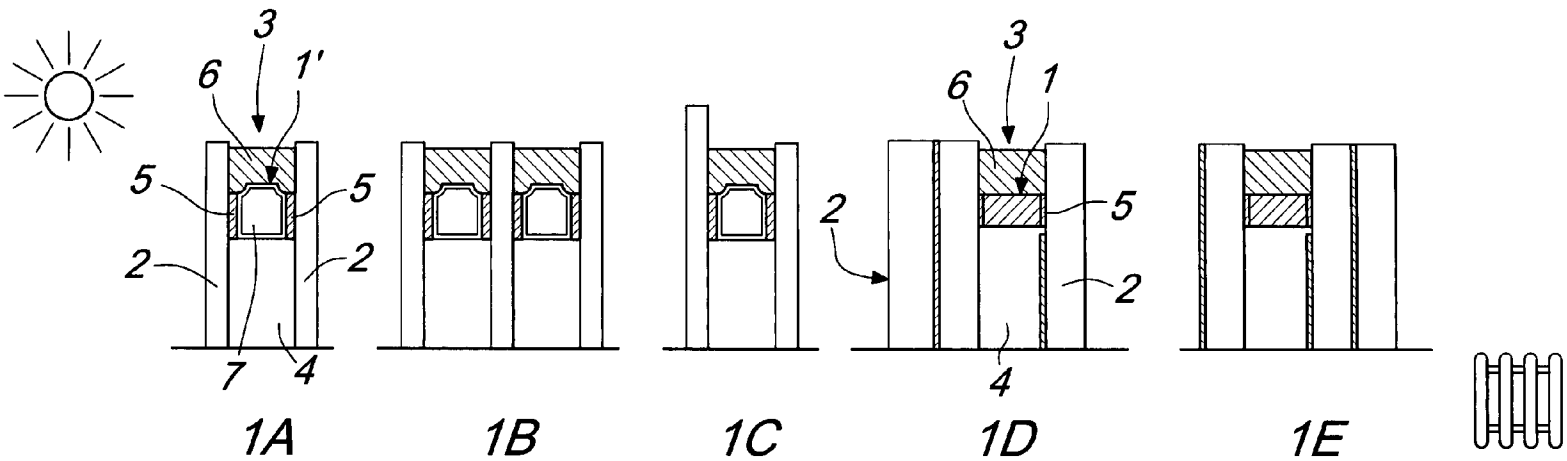
FIG. 1 is a partial sectional view of a series of typical configurations of a double-glazing unit.

As already described, FIG. 1 schematically illustrates, in a sectional view, the portion of various possible configurations of a double-glazing unit 3 which, in its basic form, is constituted substantially by two glass panes 2, which are mutually substantially parallel and are spaced by interposing a spacer profile, which is constituted in particular by a tape 1, which is applied along their entire perimeter and is rigidly coupled thereto by a first seal 5 and by a second seal 6. A chamber 4 which contains air or a gas or a gas mixture with insulating properties remains between the two glass panes 2.

Figure 2:
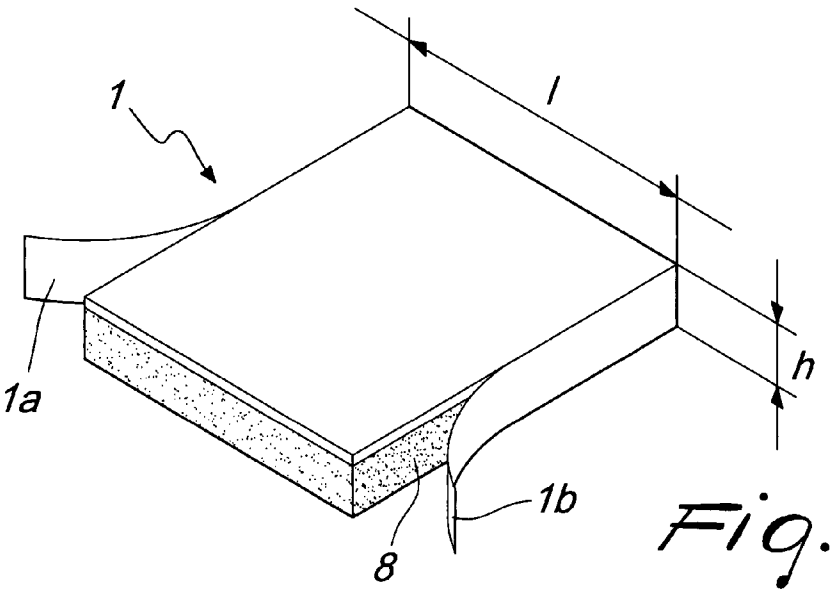
FIG. 2 is an axonometric view of a portion of a flexible tape which can be applied with the machine according to the invention.
Figure 3:
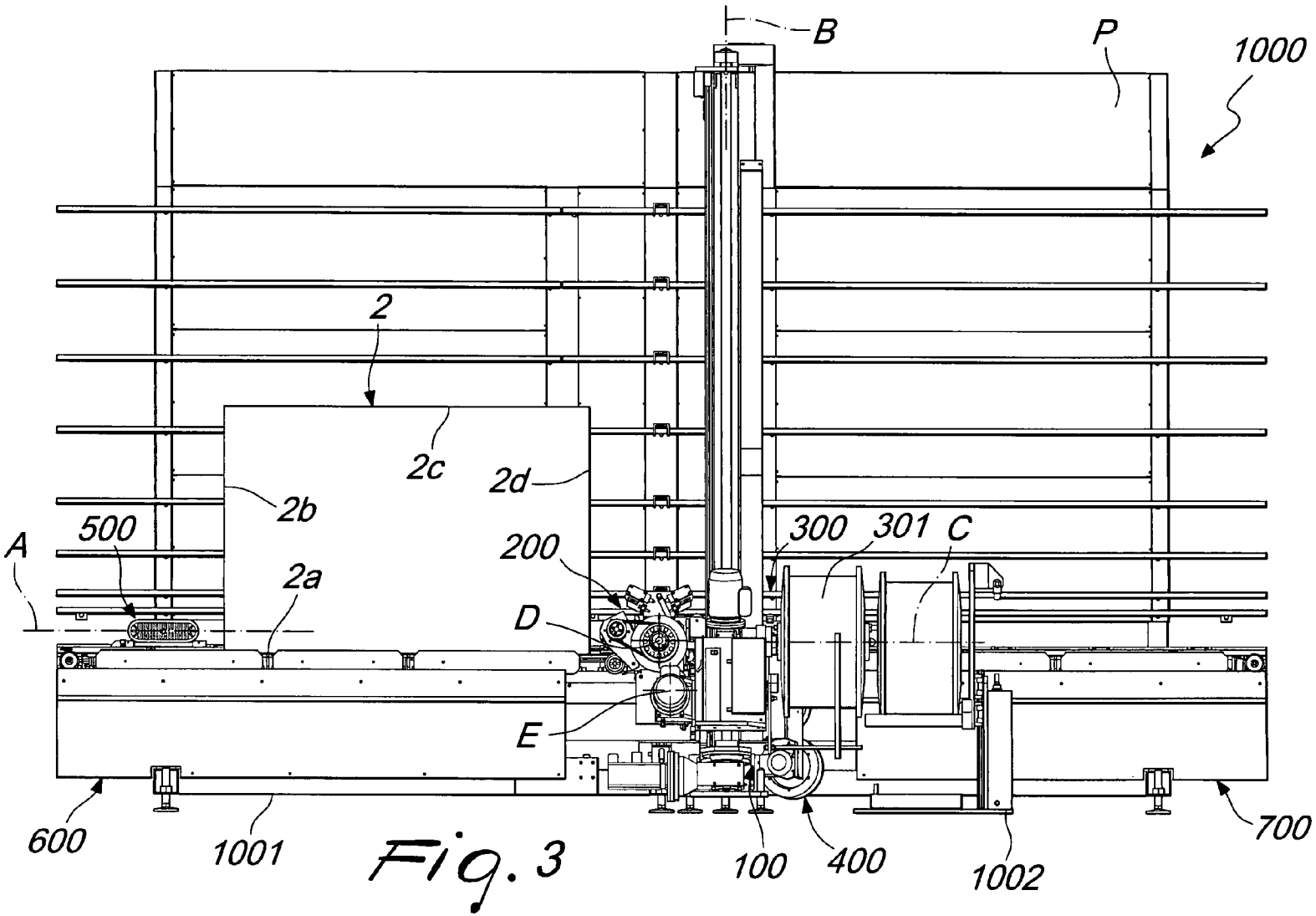
FIG. 3 is a general front view of a machine according to the invention.
Figure 3A:
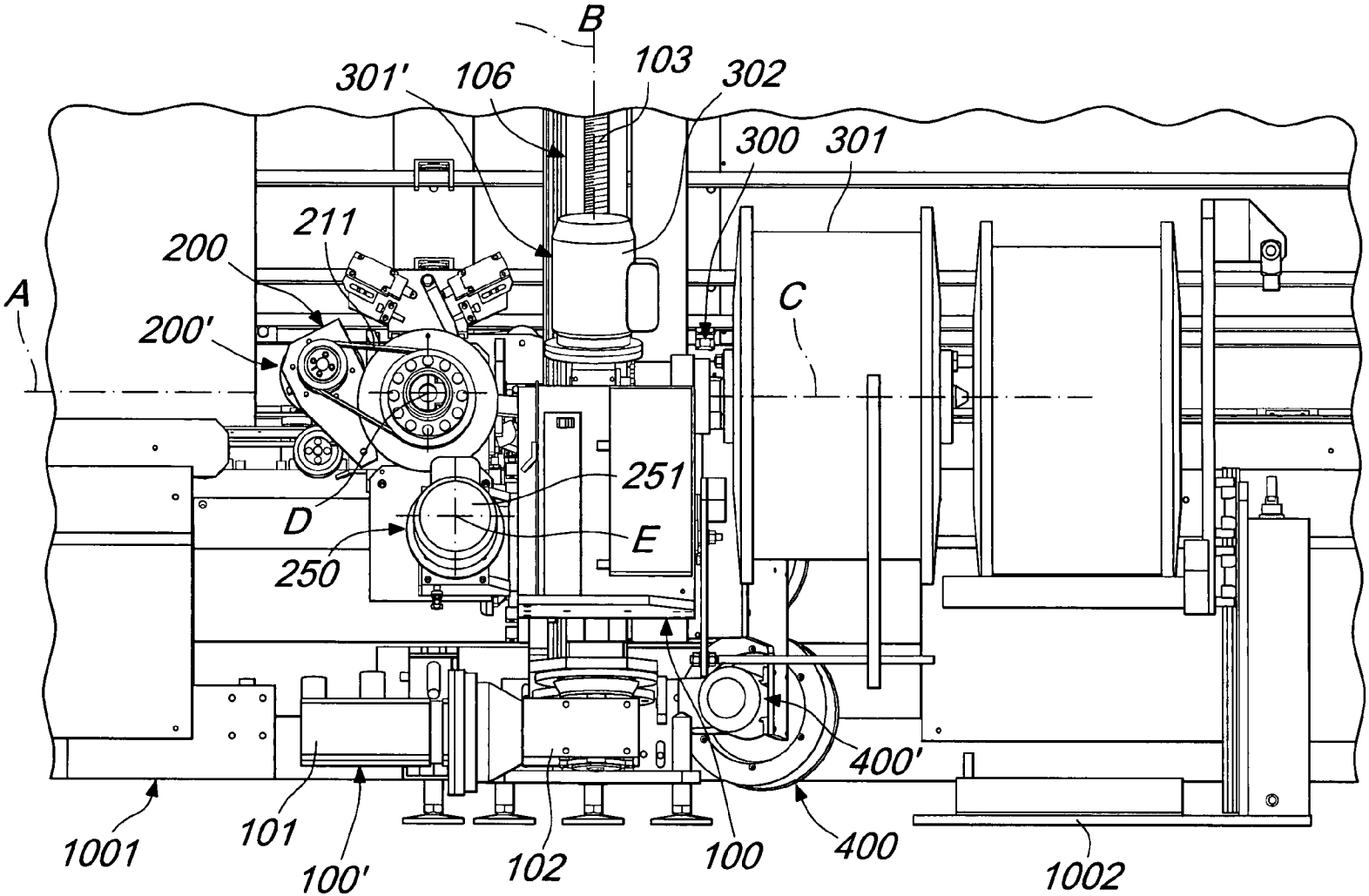
FIG. 3*a* is an enlarged-scale view of a detail of FIG. 3.

FIG. 2 illustrates a portion of a tape 1 which can be applied by means of the machine according to the invention; it is constituted by a flexible material, such as for example an expanded synthetic material such as silicone or EPDM, and has generally a right-angled quadrangular, usually rectangular, transverse cross-section, having a height h and a width 1. The two opposite lateral surfaces of the tape 1, which are intended to make contact with the faces of the two glass panes 2 between which it is interposed, are coated with an adhesive 8, for example of the acrylic type, and are coated temporarily by a respective protective film 1*a* and 1*b*, which is removed when the tape 1 is applied to the glass panes 2. If the spacer profile is constituted by the tape 1, the first seal 5 is provided by the adhesive 8 itself, while the second seal 6 is constituted by a sealant, for example of the butyl type, which is applied in a dedicated station. The tape 1 is an intermediate component, which is supplied wound on spools, from which it is gradually unwound in order to be applied to the glass panes 2.

However, alternative embodiments of the tape 1 which can be applied with the machine according to the invention are also possible, provided that it is made of flexible material and is supplied wound on storage spools.

With reference to FIGS. 3, 3*a*, 4 and 4*a*, the machine 1000 comprises a machine body 1001 in which there is a substantially vertical plane of arrangement P for at least one substantially flat glass pane 2.

Figure 6:
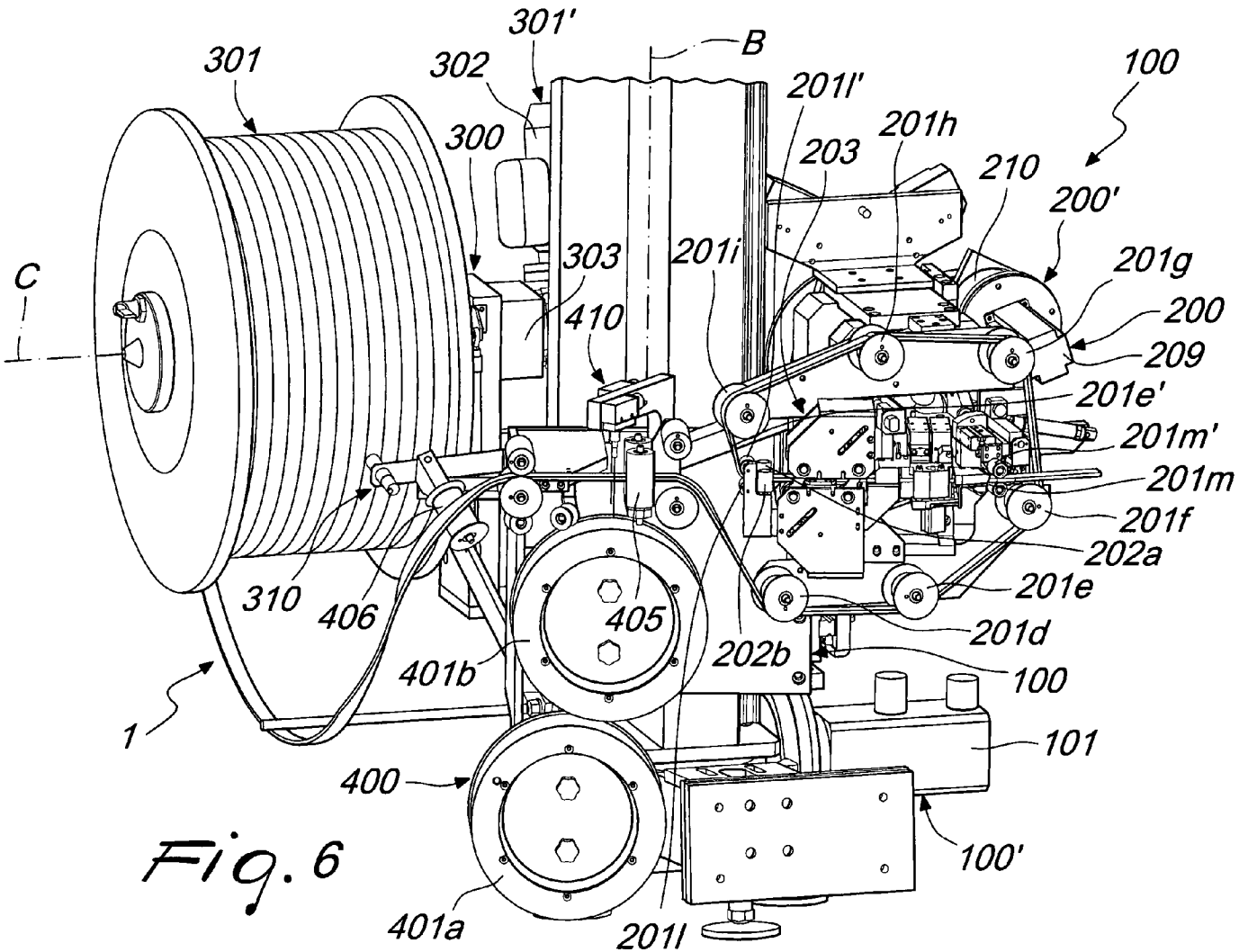
FIG. 6 is a partial axonometric view of the carriage of the machine according to the invention, taken from the side that faces the glass pane.

A carriage 100 is associated with the machine body 1001 and supports a head 200 for applying the tape 1 along the perimetric edge of the glass pane 2; the application head 200 has means 203 for feeding the tape 1, shown in FIG. 6, rigidly coupled thereto.

The carriage 100 and the glass pane 2 can perform a relative translational motion along a first axis A and a second axis B, which are mutually substantially perpendicular and parallel to the plane of arrangement P; in a preferred embodiment, the glass pane 2 can perform a translational motion along the first axis A, which lies substantially horizontally, by way of movement means 500, while the carriage 100 can perform a translational motion along the second substantially vertical axis B.

Means 300 for supporting at least one spool 301 for storing the tape 1 are rigidly coupled to the carriage 100; said spool 301 is supported so that it can rotate about its own longitudinal axis C, which is substantially horizontal and parallel to the plane of arrangement P.

The application head 200 and the supporting means 300, and therefore the spool 301, are rigidly coupled to the carriage 100 in its translational motions along the second axis B. The application head 200 is associated with the carriage 100 so that it can rotate about a third axis D, which is substantially perpendicular to the plane of arrangement P. The application head 200, further, is associated with the carriage 100 so that it can perform a translational motion along a fourth axis E, which is also substantially perpendicular to the plane of arrangement P. The supporting means 300 are independent of the application head 200 both in its rotary motion about the third axis D and in its translational motion along the fourth axis E.

Moreover, the carriage 100 supports means 400 for winding the protective films 1*a* and 1*b* which cover the opposite lateral surfaces of the tape 1; the winding means 400 are rigidly coupled to the carriage 100 in its translational motions along the second axis B and are independent of the rotary motions about the third axis D and translational motions along the fourth axis E of the application head 200 with respect to the carriage 100.

Further, the machine 1000 comprises first means 500' for actuating the means 500 for moving the glass pane 2 along the first axis A, second means 100' for actuating the carriage 100 with a translational motion along the second axis B, third means 200' for actuating the application head 200 so that it rotates about the third axis D, and fourth means 203' for actuating the feeder means 203 of the tape 1, which are concatenated, interpolated, or interlocked and are driven by a controller, not shown, for synchronizing and coordinating the relative movements of the application head 200 and of the glass pane 2 and the feeding motion of the tape 1 for its application along the perimeter of the glass pane 2.

Fifth means 301' for rotationally actuating the spool 301 about its longitudinal axis C, and means 310 for detecting the tension of the unwinding of the tape 1 from said spool and/or the rotation rate thereof are rigidly associated with the supporting means 300; the fifth actuation means 301' are of the reversible type and are actuated by the controller of the machine 1000 in response to feedback signals received by the sensing means 310 for unwinding or rewinding the tape 1, as described in detail hereinafter.

Sixth means 250 are associated with the application head 200 in order to actuate its translational motion along the fourth axis E and are also driven with feedback by the controller of the machine 1000.

Likewise, seventh means 400' for actuating the winding means 400 are provided which are driven with feedback by the controller of the machine 1000 for winding or unwinding the films 1*a* and 1*b*, and there are sensor means 410 for detecting the tension of the films 1*a* and 1*b*, which are suitable to send to the controller signals for the feedback of the seventh actuation means 400' in order to stop them in case of abnormal tensions of the films 1*a* and 1*b*.

Figure 7:
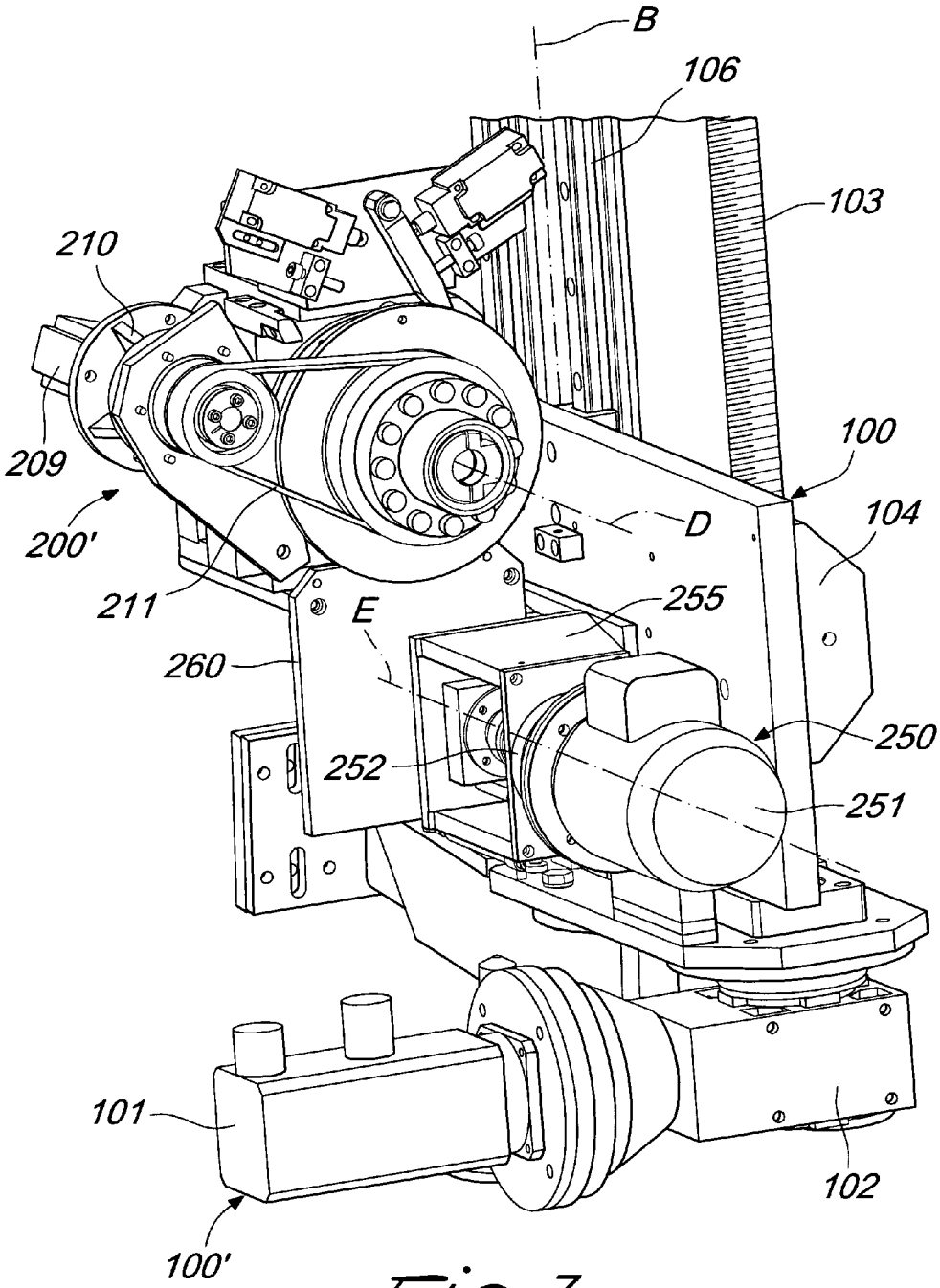
FIG. 7 is an axonometric view of a portion of the carriage of the machine according to the invention, taken from the opposite side with respect to the side that faces the glass pane.
Figure 7A:
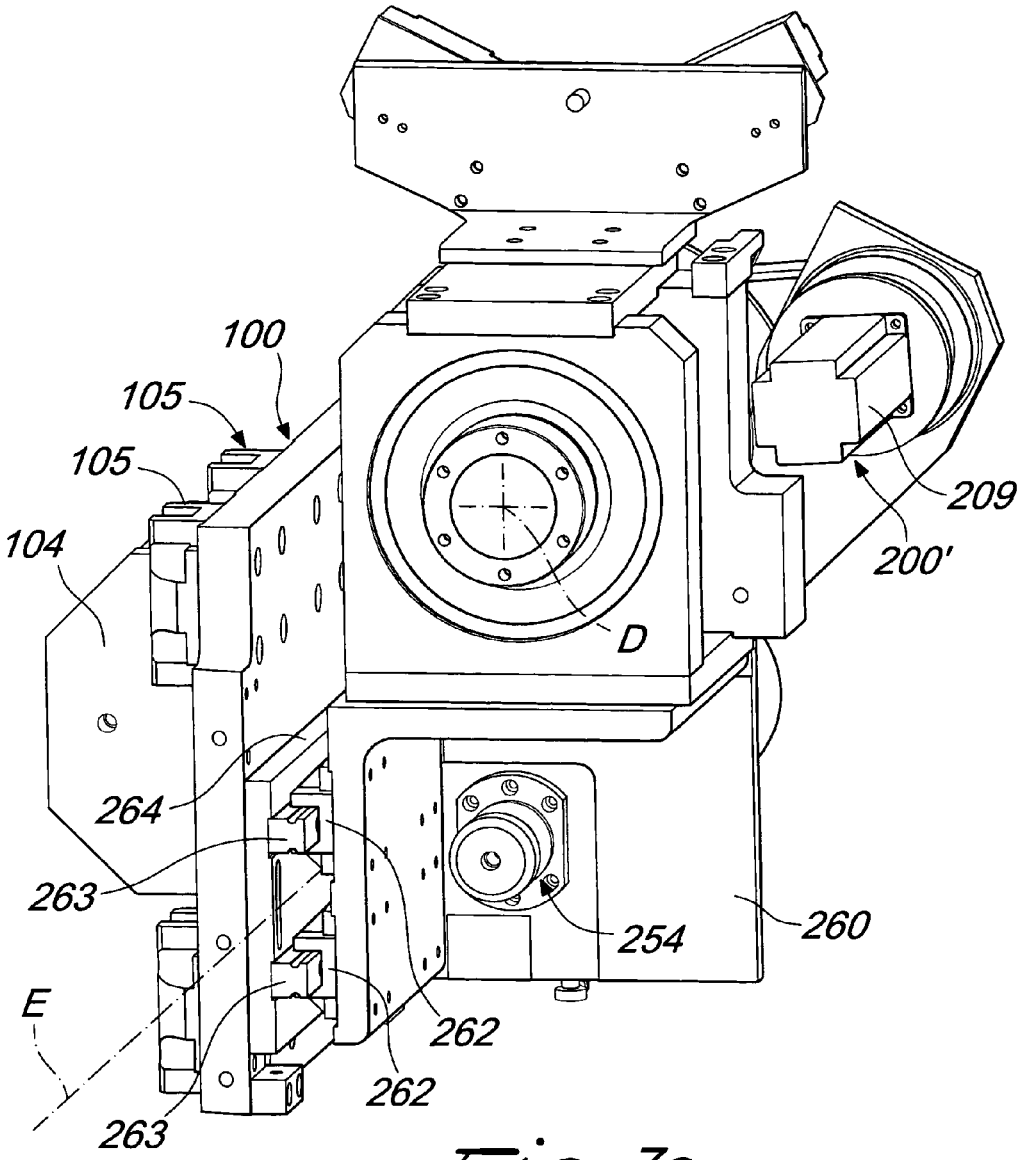
FIGS. 7*a* and 7*b* are axonometric views of the coupling between the application head and the carriage of the machine according to the invention.
Figure 7B:
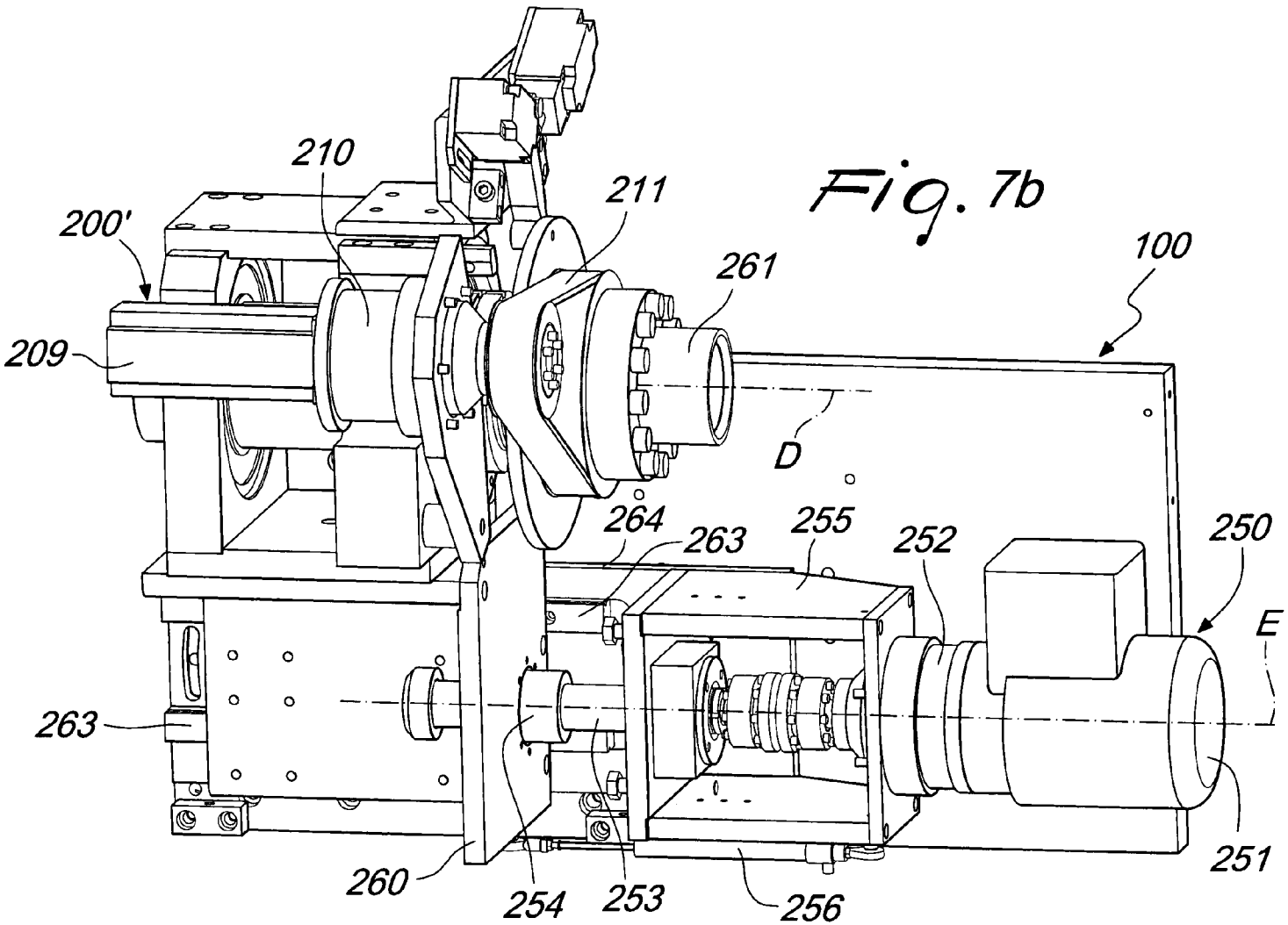

With particular reference to FIGS. 5-7*b*, the carriage 100 is provided with sliding blocks 105, by way of which it is coupled so that it can move along straight guiding means, constituted by two guides 106, which are substantially parallel to the second axis B. The second means 100' for actuating the translational motion of the carriage 100 along the guides 106 are constituted by a ballscrew 103, which is substantially parallel to the guides 106 and engages a lead screw 104, which is indicated but hidden by the corresponding brackets in FIGS. 7 and 7*a* and is rigidly coupled to the carriage 100, the lower end of the ballscrew 103 being coupled to motor means, which are constituted by a motor 101 of the reversible type and by a reduction unit 102, which are rigidly coupled to the machine body 1001.

The application head 200 comprises a supporting body 260, with which it is associated so that it can rotate about the third axis D. The supporting body 260 has rigidly coupled third means 200' for actuating the rotation of the application head 200, which comprise motor means, constituted by a motor 209 of the reversible type and by a reduction unit 210, which by virtue of a toothed-belt drive 211 transmit motion to the rotation shaft 261 of the application head 200.

The supporting body 260 is provided with sliding blocks 262, which are coupled so that they can perform a translational motion along straight guides 263, which are substantially parallel to the fourth axis E and are formed in a plate 264, which is fixed to the carriage 100. The sixth actuation means 250, which move the application head 200 with a translational motion along the fourth axis E, are constituted by a ballscrew 253, which is substantially parallel to the fourth axis E and has an end which engages a lead screw 254, which is formed monolithically with the supporting body 260, and an opposite end which is coupled to motor means, constituted by a motor 251 of the reversible type and by a reduction unit 252, which are supported by a box-like body 255, which is fixed to the carriage 100.

The opposite ends of a potentiometer 256 are articulated respectively to the supporting body 260 and to the box-like body 255.

Figure 8:
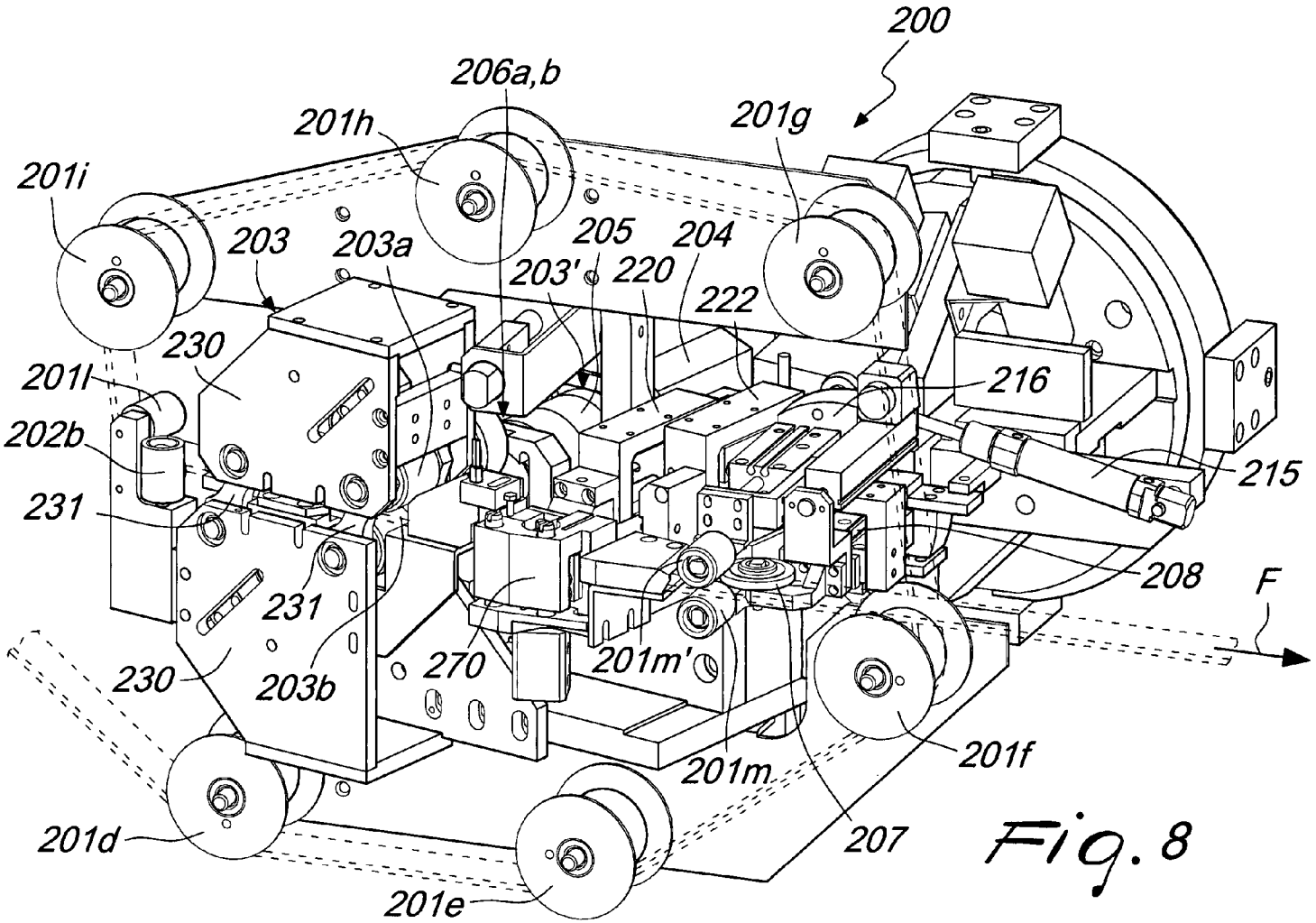
FIG. 8 is an axonometric view of the application head of the machine according to the invention, taken from the side that faces the glass pane.
Figure 9:
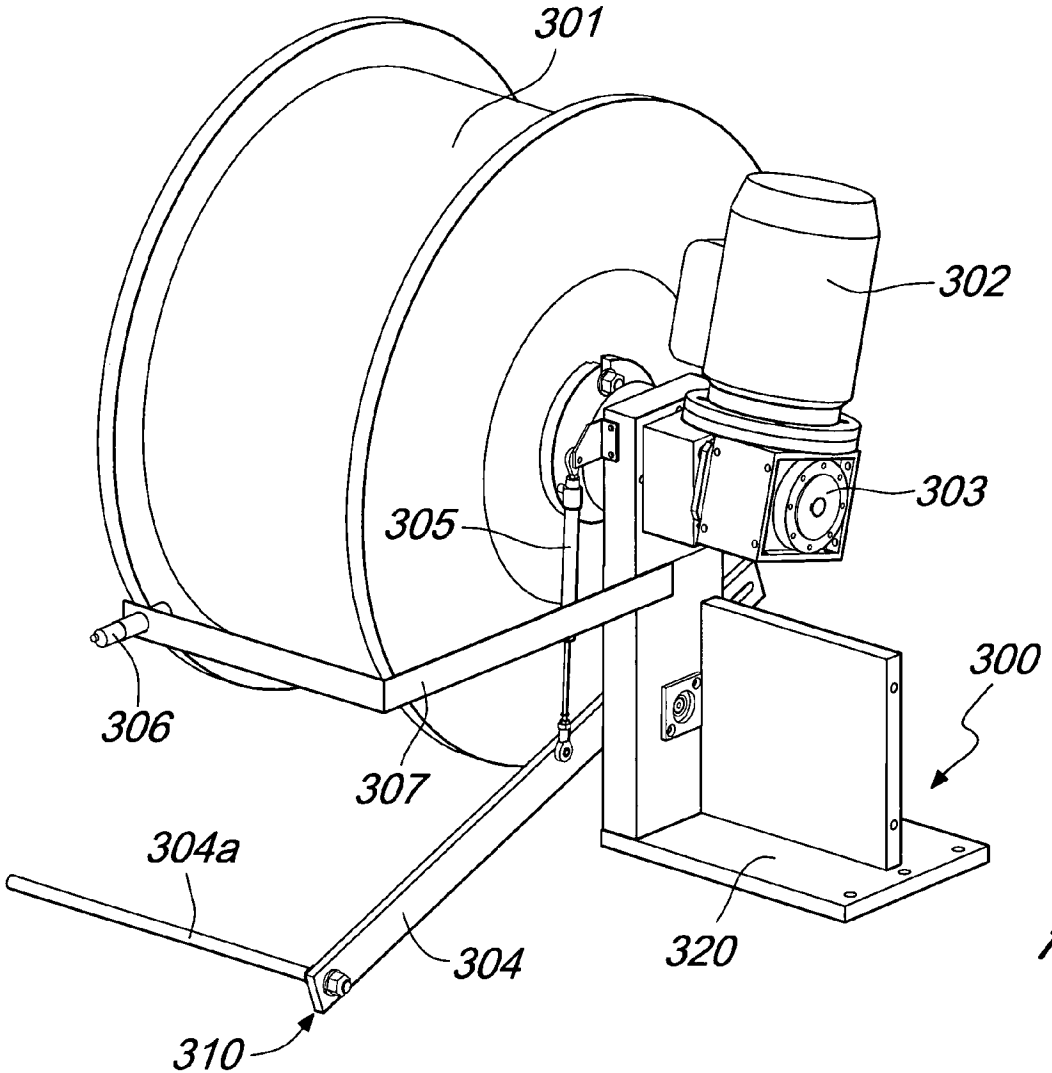
FIG. 9 is an axonometric view of the spool supporting means, which are associated with the carriage of the machine according to the invention.

With particular reference to FIGS. 6 and 8, the application head 200 supports a plurality of free rollers 201*d*-201*m*, which are arranged with an axis which is perpendicular to the plane of arrangement P and in which the rollers 201*l* and 201*m* are contrasted by corresponding contrast rollers 201*l'* and 201*m'*; said rollers 201*d*-201*m* form a guided path for the tape 1 unwound from the spool 301 and make contact with the tape 1 along its width 1, i.e., the faces thereof which are perpendicular to the glass pane 2. There are also two free rollers 202*a* and 202*b*, which are arranged with their axis parallel to the plane of arrangement P and are suitable to make contact with the lateral surfaces of the tape 1. As will become better apparent hereinafter, the portion of tape 1 along the guided path formed by the free rollers 201*d*-201*m* and by the free rollers 202*a* and 202*b* acts as a buffer, which allows the rotation of the application head 200 through 360°, 270° in the case of a right-angled quadrangular sheet, to be performed in separate steps or progressively and in combination in the case of glass panes having an arc-like contoured profile. This buffer, together with the feedback control performed by the controller on the fifth means 301' for actuating the spool 301 and on the seventh means 400' for actuating the winding means 400, allows to prevent the tape 1 from being subjected to abnormal tensions, particularly during the rotation of the application head 200 about the third axis D. In particular, if the application head 200 turns without applying the tape 1, for example when, at the comers of a right-angled quadrangular glass pane, the application head 200 performs a rotation through 90° without applying the tape 1, the excess tape 1 along the guided path is taken up and rewound on the spool 301. If instead the application head 200 turns and at the same time applies the tape 1, for example if it follows the arc-like profile of a glass pane 2, the tape 1 is fed continuously.

The feeder means 203 are interposed between the pair of free rollers 202*a* and 202*b* and the free rollers 201*m*-201*m'* and are constituted by two continuous belt conveyors 203*a* and 203*b*, which are arranged one above the other along the longitudinal extension of the tape 1 and are suitable to make contact with its opposite faces. Said continuous conveyor belts 203*a* and 203*b* are supported by respective supporting blocks 230, which are connected by linkages 231 and are at an adjustable distance with respect to each other. The continuous belt conveyors 203*a* and 203*b* are actuated by the fourth actuation means 203', which comprise motor means constituted by a motor 204, a reduction unit 205, and by gear transmission means 206*a* and 206*b*.

The feeder means 203 convey the tape 1 along the advancement direction F at a speed which is substantially equal to the speed of the relative motion between the application head 200 and the glass pane 2.

Downstream of the free rollers 201*m* and 201*m'*, along the advancement direction F of the tape 1, there is a presser element, constituted by a roller 207 which is actuated by a linear actuator such as a cylinder 208 and is suitable to press the tape 1 against the glass pane 2.

Conveniently, as will become better apparent hereinafter, the free rollers 201*m* and 201*m'* are fixed to a supporting body 216, which is pivoted about a pivot, which is not shown and is substantially perpendicular to the plane of arrangement P, and is actuated so as to oscillate by a linear actuator, which is constituted by a cylinder 215; the cylinder 215 actuates the oscillation of the supporting body 216 on a plane which is parallel to the plane of arrangement P, so as to move the free rollers 201*m* and 201*m'* away from the glass pane 2 just before the final portion of the tape 1 is applied thereto, in order to avoid interfering with its connection to the portion applied at the beginning of the process.

Figure 12:
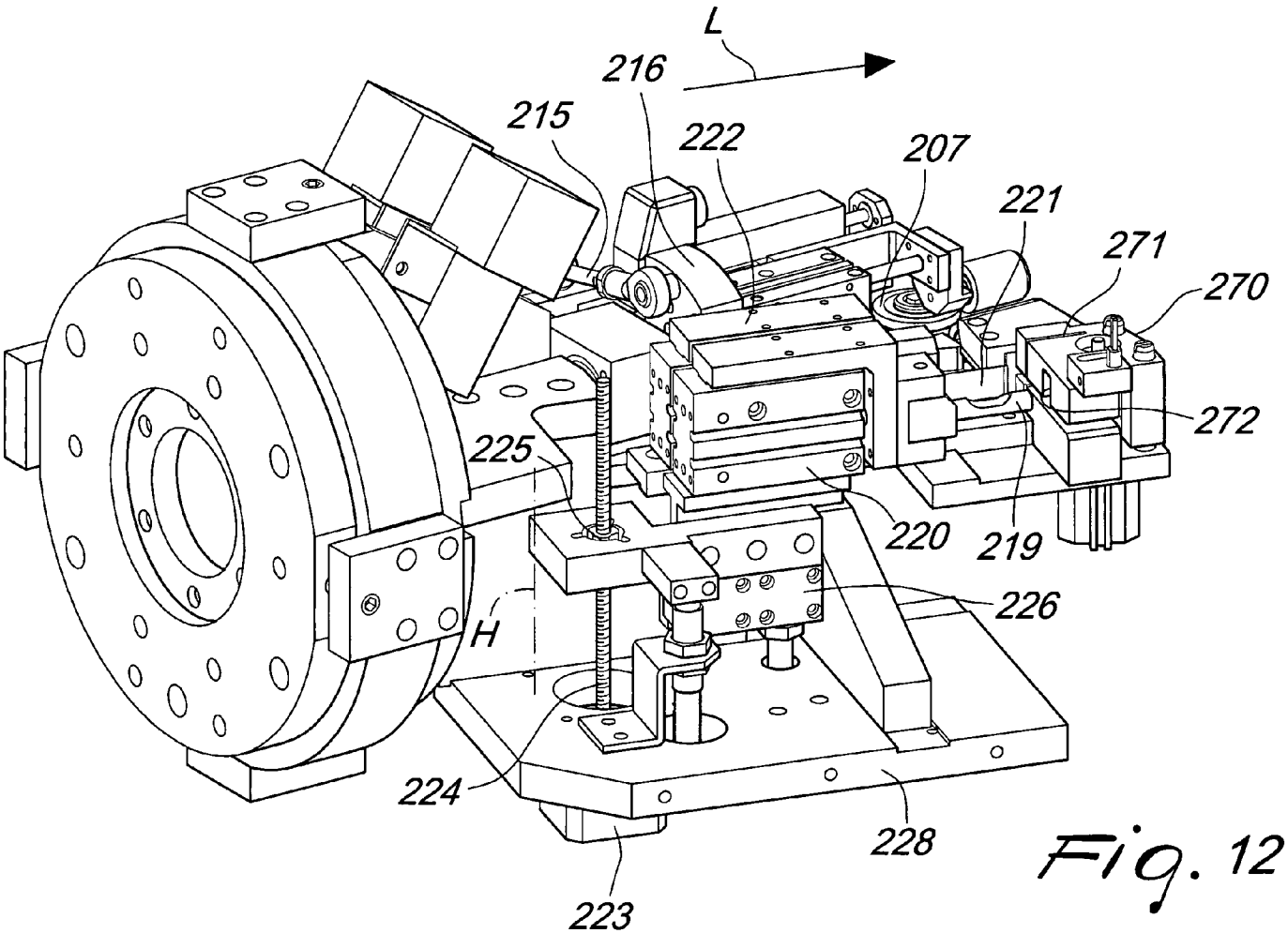
FIG. 12 is an axonometric view of a detail of the application head of the machine according to the invention, which comprises means for cutting and/or scoring the tape and means for adjusting their height.
Figures 13E, 13F, 13G, 13H:
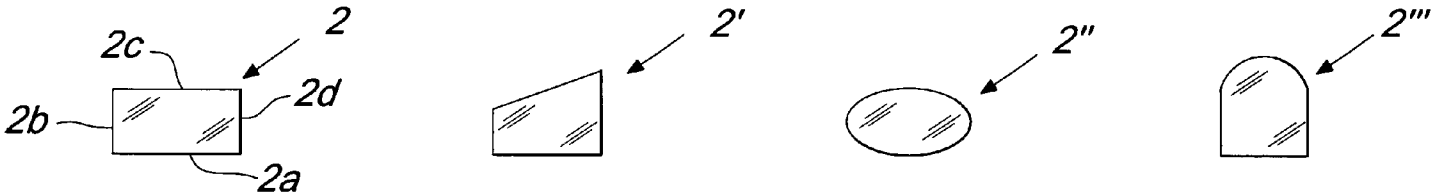
FIGS. 13*e*-13*h* illustrate various configurations of a flat glass pane which is suitable to be worked by the machine according to the invention.

With particular reference to FIGS. 8 and 12, the application head 200 further comprises means for scoring and/or cutting the tape 1 along a first direction L, which is substantially parallel to the width 1 of the tape 1. Said scoring and/or cutting means are interposed between the feeder means 203 and the roller 207 and are associated with means for adjusting their height along a second direction H, which is substantially parallel to the height h of the tape 1, in order to adjust the depth of the scoring and/or cut. In particular, the scoring and/or cutting means comprise a die-cutting element 219, which is for example circular or prism-shaped, and a blade element 221, which are associated with the application head 200 and can move with a translational motion along the first direction L by virtue of linear actuator means, constituted respectively by a cylinder 220 and a cylinder 222. The die-cutter element 219 and the blade element 221 cooperate with an abutment 270, in which respective insertion seats 271 and 272 are formed.

The height adjustment means comprise a slider element 226, on which the die-cutter element 219 and the blade element 221 and the corresponding cylinders 220 and 222 are fixed. The slider element 226 is associated so that it can slide along linear guiding means, not shown, which are associated with a base 228, which is rigidly coupled to the application head 200, and are arranged substantially parallel to the second direction H. The slider element 226 is moved with a translational motion by actuation means, which are actuated by the controller of the machine 1000 and are constituted by a ballscrew 224, which engages a lead screw 225, which is formed in the slider element 226 and is coupled, at one end, to a motor 223, which is anchored to the base 228.

The illustrated height adjustment means are suitable to adjust the height of the die-cutter element 219 and of the blade element 221 rigidly with respect to each other; alternative embodiments of the height adjustment means are possible, so as to adjust the height of the die-cutter element 219 and of the blade element 221 independently of each other, as can be easily understood by the person skilled in the art.

Merely by way of example, FIGS. 13*a*-13*d* illustrate portions of tape 1 in which scoring lines or cuts having different depths are obtained by adjusting the height of the die-cutter elements 219 and of the blade element 221, and the corresponding configurations for application to the glass pane 2.

FIGS. 13*a* and 13*b* illustrate two portions of tape 1 in which, by way of the die-cutter element 219 adjusted at a different height, scoring lines 19 having different depths have been obtained which allow to fold said tape so as to form angles $\alpha$ of various magnitudes. FIG. 13*c* illustrates a portion of tape 1 in which there is a cut 20 which is shallower than its height h and acts as a reference for the insertion of the pins or tabs for fixing frames 21 of the type with so-called Georgian bars, inserted in the chamber 4 of the double-glazing unit 3. Finally, FIG. 13*d* illustrates a portion of tape 1 in which there is a cut 20 which passes through its entire height h in order to provide head-to-tail joints provided along one side of the glass pane 2, said joints being necessary for example when the profile of the glass pane 2 has all rounded corners.

With particular reference to FIGS. 3, 3*a*, 6 and 9, the supporting means 300 comprise a bracket element 320, which is rigidly coupled to the carriage 100 and with which the spool 301 can be associated rotatably, while the fifth means 301' for actuating the rotation of the spool 301 comprise motor means, constituted by a motor 302 of the reversible type and by a reduction unit 303, which are supported by the bracket element 320.

The sensing means 310 comprise a dancer arm 304, in which one end is articulated to the bracket element 320 so that it can oscillate and the opposite end is provided with a cantilevered arm 304*a*, which is suitable to make contact with the unwinding tape 1, and a potentiometer 305, the opposite ends of which are articulated respectively to the dancer arm 304 and to the bracket element 320. The sensing means 310 further comprise a sensor element 306, which is supported by a bar 307 anchored to the bracket element 320 and is suitable to detect the instantaneous diameter of the spool 301. The sensing means 310 send to the controller feedback signals for the motor 302, so as to have an instantaneous feed rate of the tape 1 which is substantially equal to the rate of its application to the glass pane 2, i.e., to the relative speed between the application head 200 and the sheet 2. If the dancer arm 304 detects an excessive tension of the tape 1, the controller acts on the motor 302 so as to increase the rotation rate of the spool 301 in the direction for unwinding the tape 1; if instead the dancer arm 304 detects a slackening of the tape 1, the controller acts on the motor 302, slowing its unwinding speed or reversing its direction of rotation in order to rewind the excess tape onto the spool 301; this occurs for example when the application head 200 turns without applying the tape 1.

Conveniently, the machine 1000 comprises a lifting unit 1002, which is arranged on the ground proximate to the carriage 100 when it is at the lower stroke limit, in order to facilitate the replacement of the spool 301 with another one.

Figure 10:
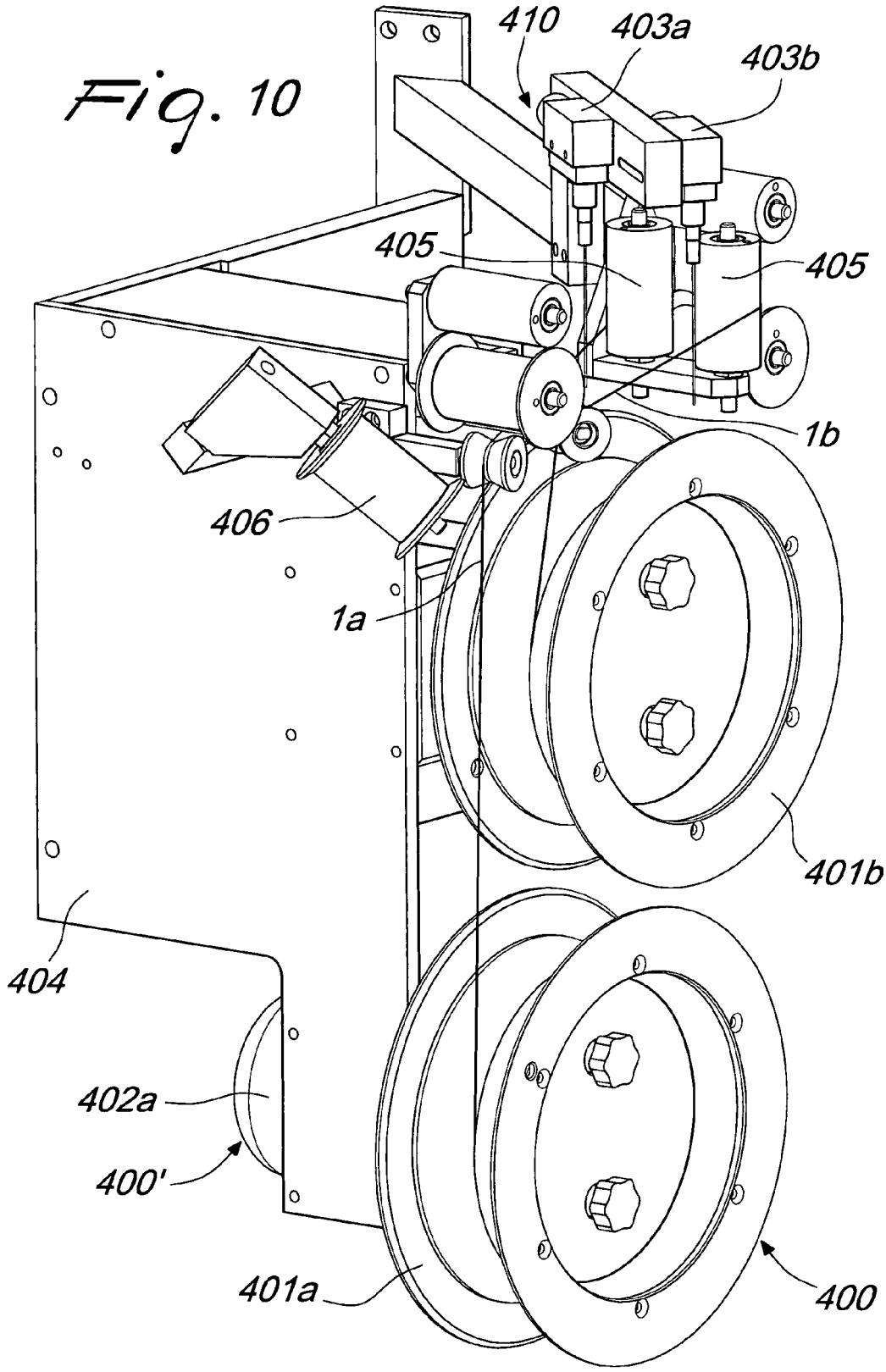
FIG. 10 is an axonometric view of the means for winding up the tape protection films associated with the carriage of the machine according to the invention.

With reference to FIG. 10, the winding means 400 comprise two reels 401*a* and 401*b* for winding respectively the films 1*a* and 1*b*. The reels 401*a* and 401*b* are rotatably associated with a support 404, which can be fixed to the carriage 100; the seventh actuation means 400', which are suitable to turn the two reels 401*a* and 401*b*, comprise motor means, which are constituted by two motors 402*a* and 402*b* of the torque-control type, which are anchored to the support 404.

The sensors 410 comprise probe means 403*a* and 403*b*, which are suitable to make contact with the two films 1*a* and 1*b* and to send to the controller feedback signals for the motors 402*a* and 402*b* in order to stop them in case of failure or damage of the films. The control of the motors 402*a* and 402*b* by the controller is of the torque-control type.

Finally, the support 404 supports first rollers 405 for guiding the films 1*a* and 1*b* and second rollers 406 for guiding the tape 1.

Figure 11:
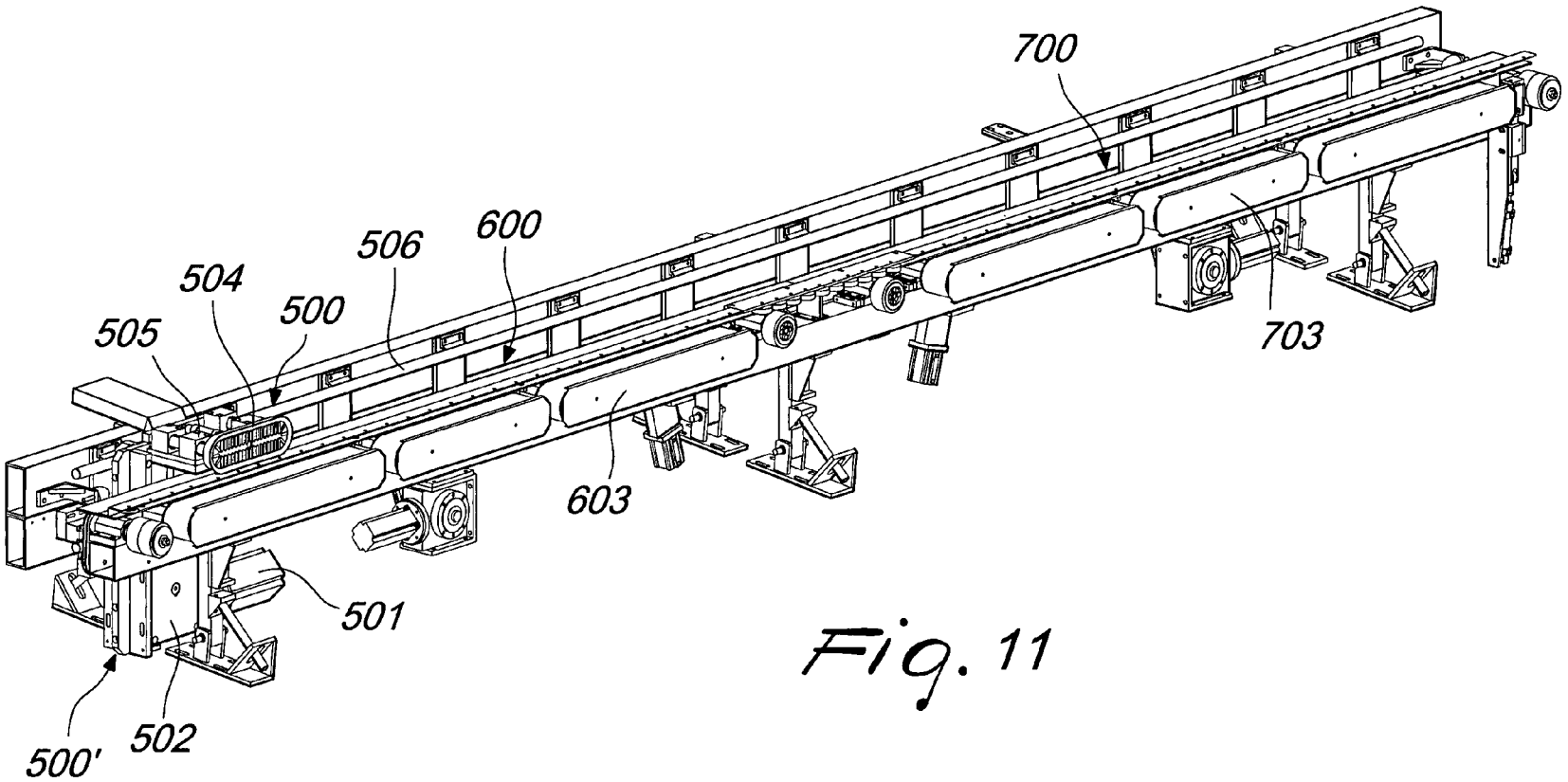
FIG. 11 is an axonometric view of the movement means and of the input and output conveyance means for the glass pane of the machine according to the invention.
Figure 11A:
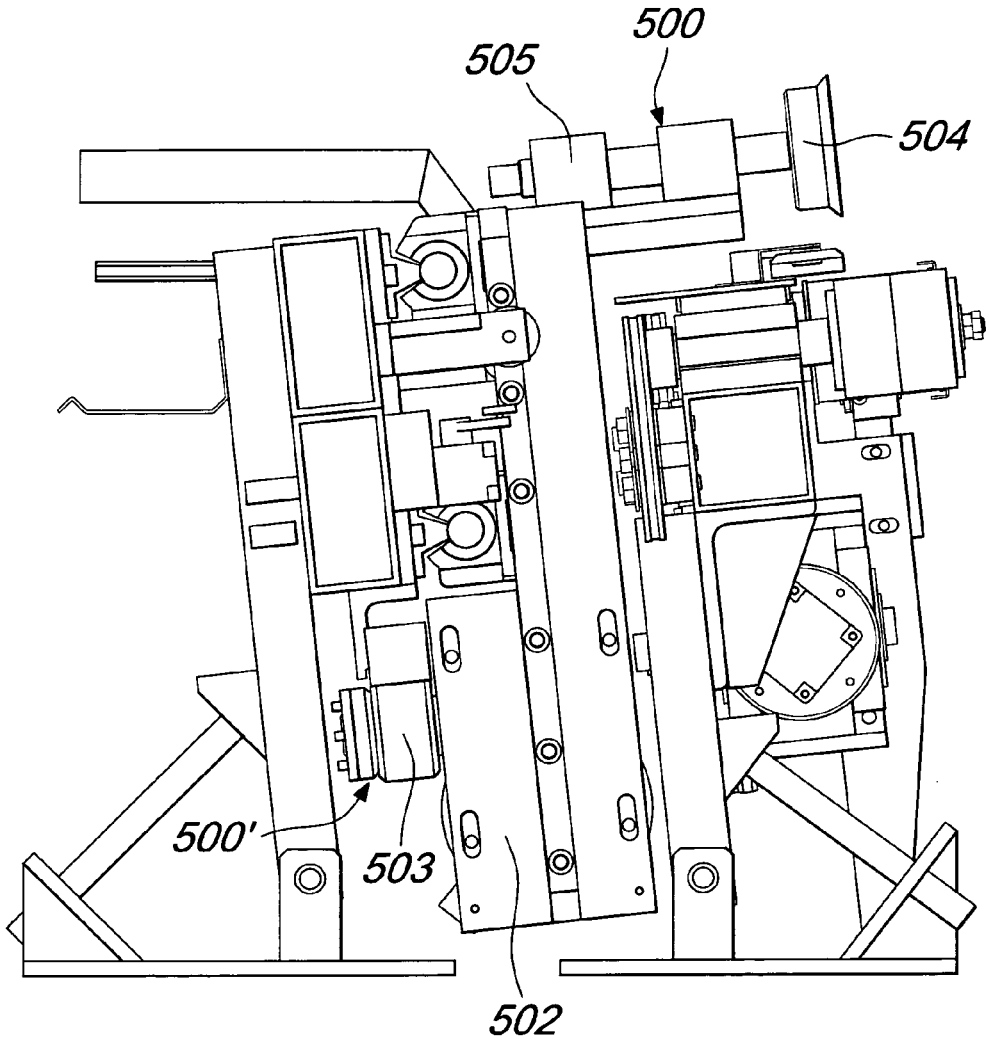
FIG. 11*a* is a side view of FIG. 11.

With reference to FIGS. 11 and 11*a*, the means 500 for moving the glass pane 2 along the first axis A comprise grip means of the sucker type 504 for the sheet 2, which are rigidly associated with a truck or slider 505, which can perform a translational motion along linear guides 506, which are substantially parallel to the first axis A and are formed in the machine body 1001. The first actuation means 500' comprise motor means, which are constituted by a reversible motor 501 and by a reduction unit 502, which are coupled to the slider 505 with the interposition of means 503 for converting rotary motion into a rectilinear motion of the rack-and-pinion type, the controller acting on the motor 501.

The machine 1000 further comprises input conveyor means 600 and output conveyor means 700, which are arranged respectively upstream and downstream of the carriage 100 with respect to the advancement direction of the glass pane 2 along the first axis A and are associated with respective motorization means, not shown in detail, which are controlled by the controller.

The input and output conveyor means 600 and 700 comprise supporting and advancement rollers, respectively 602 and 702, as well as supporting and advancement belts, respectively 603 and 703, on which the lower edge of the glass pane 2 rests, said rollers and belts being known to the person skilled in the art.

Figure 14:
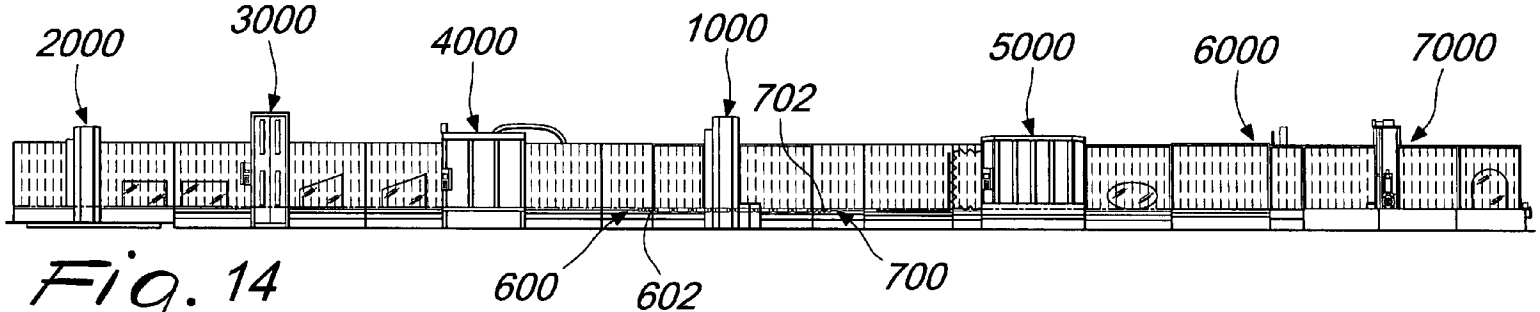
FIG. 14 is a partial schematic front view of a line for working flat glass pane for manufacturing double-glazing units, in which the machine according to the invention is inserted.
Figure 15:
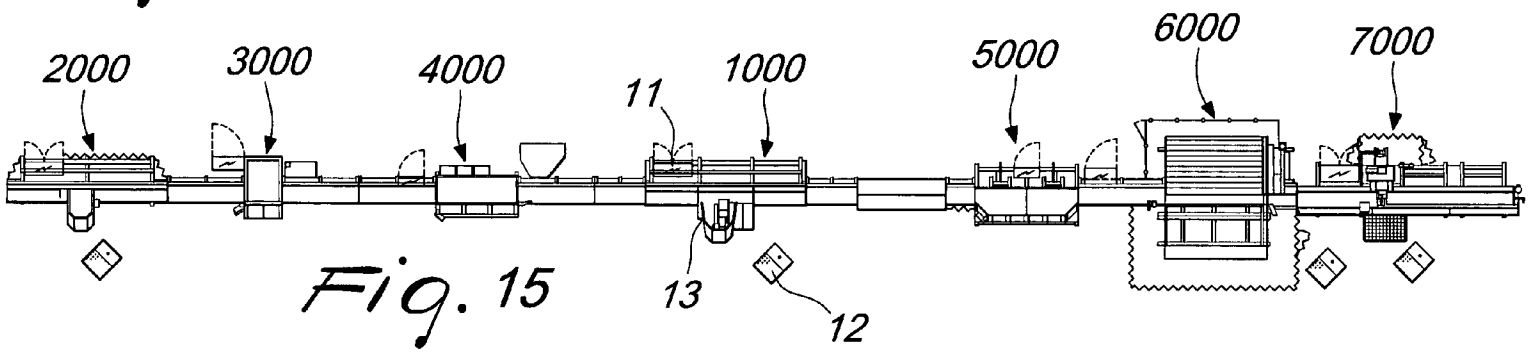
FIG. 15 is a plan view of FIG. 14.

FIGS. 14 and 15 illustrate schematically a double-glazing unit production line, along which the machine 1000 is inserted, completed by an electrical or electronic control panel 11, a control booth 12, and protective structures 13, for example mechanical screens, optical barriers, laser barriers, electrically sensitive mats, or others.

Along the production line, upstream of the machine 1000, the following are arranged in succession: a station 2000 for removing from the glass pane 2 any coatings, an arrissing station 3000, and a washing station 4000. Downstream of the machine 1000, the following are arranged in succession: a station 5000 for coupling on the glass pane 2 to which the tape 1 has been applied, a second glass pane 2, a station 6000 for injecting insulating gases inside the chamber 4 formed between the two coupled glass panes 2, and a station 7000 for sealing the double-glazing unit. However, alternative arrangements of the various stations along the production line are also possible.

FIGS. 13*e*-13*h* illustrate glass panes 2, 2', 2" and 2'", which have different profiles and can be processed by the machine 1000.

With particular reference to glass panes 2 having a right-angled quadrangular profile in which two opposite sides 2*a* and 2*c* are parallel to the first axis A and the other two opposite sides 2*b* and 2*d* are parallel to the second axis B, the operation of the machine 1000 is as follows.

A sensor, which is known and not shown, provides the controller with an input signal which relates to the position of the edge of the glass pane 2 and the information required to follow the quadrangular profile and in particular to control the movement means 500, the input conveyor means 600, the carriage 100 and the feeder means 203.

The glass pane 2, arranged so that its lower horizontal side 2*a* rests on the input conveyor means 600, is conveyed to the process start position by the input conveyor means 600 themselves, in cooperation with slowing sensors and stop mechanisms, of a known type. In this position, it is located downstream of the carriage 100, which is also arranged in the process start configuration (FIGS. 3 and 3*a*), so as to be at such a height that the portion of the tape 1 that is fed by the feeder means 203 is parallel to the side 2*a* and lies at a preset distance from it. The application of the tape 1 along the side 2*a* occurs by producing the translational motion of the glass pane 2 so as to retract; the translational motion of the glass pane 2 is actuated by the movement means 500 and optionally also by the input conveyance means 600 which cooperate with them. During this movement, the controller controls and actuates the first actuation means 500' and the fourth actuation means 203' in order to synchronize the translational speed of the glass pane 2 and the feed rate of the tape 1. During application, the spool 301, the rotation of which is actuated by the motor 302, which is not synchronous, feeds the tape 1 "on demand" when needed by the feeder means 203 by virtue of the feedback signals provided by the dancer arm 304 to the controller. Also during application, the two films 1*a* and 1*b* are removed from the opposite sides of the tape 1 and are wound around the reels 401*a* and 401*b* actuated by the torque-control motors 402*a* and 402*b*.

Once the application of the tape 1 along the lower horizontal side 2*a* has ended, the controller drives the motor 209 so as to make the application head 200 perform a counterclockwise rotation (as seen by the operator) about the third axis D through 90°, so as to arrange the portion of the tape 1 that is fed by the feeder means 203 parallel to the vertical side 2*b*. During rotation, the application of the tape 1 is stopped temporarily and the excess portion of tape 1 wound around the free rollers 201*d*-201*m* slackens and is "returned" to the spool 301, with simultaneous retrieval of the films 1*a* and 1*b* from the winding means 400. In particular, the slackening of the tape 1 is detected by the dancer arm 304, which sends to the controller a feedback signal, as a consequence of which the motor 302 reverses in the direction for rewinding said tape around the spool 301; at the same time, the winding means 400 provide the necessary portions of film 1*a* and 1*b*, which are reapplied to the opposite sides of the rewound portion of tape 1.

It should be noted that during the rotary motion of the application head 200 about the third axis D, the spool 301 remains stationary.

The application of the tape 1 along the vertical side 2*b* occurs by producing the translational motion of the carriage 100 and therefore of the application heads 200 upward along the guides 106; in this step, the controller drives the fourth means 203' for actuating the feeder means 203 and the second means 100' for actuating the carriage 100 in order to synchronize the feed rate of the tape 1 and the translational speed of the carriage 100.

These operating sequences are repeated for the application of the tape 1 along the upper horizontal side 2*c*, for which the glass pane 2 is made to advance along the first axis A by the movement means 500 and along the other vertical side 2*d*, for which the carriage 100 and the application head 200 are made to perform a downward translational motion along the guides 106.

When the application head arrives at the corner formed between the side 2*a* and the side 2*d*, the controller drives the motor 251 for the translational motion of the application head 200 along the fourth axis E away from the glass pane 2 and the cylinder 15 for the oscillation of the supporting body 216 in the direction for diverting the free rollers 201*m* and 201*m'* from the tape 1 deposited on the side 2*a*. The tape 1 is cut either by the die-cutter element 219 or by the blade element 221, depending on the type of joint to be provided, and is connected to the portion applied initially.

In all the steps of application, the tape 1 is pressed against the glass pane 2 by the roller 207, which is actuated by the cylinder 208 actuated by the controller, while before the application of the tape 1 at a corner it is scored conveniently by the scoring and/or cutting means.

If the glass pane 2 has a profile which is for example arc-like, like the glass panes 2" and 2'", the data related to it are supplied in input to the controller, so as to control and coordinate the first means 500' for actuating the glass pane movement means 500, the second means 100' for actuating the translational motion of the carriage 100, the third means 200' for actuating the rotation of the application head 200 about the third axis D, and the fourth means 203' for actuating the feeder means 203, so that the horizontal motion of the glass pane, the vertical motion of the carriage 100, the rotary motion of the application head 200 and the traction motion of the tape 1 are mutually composed and coordinated so as to follow the profile of said glass pane. For this purpose, it is possible to use adjustments of the PDI type, of a known kind, so that if x is the deviation of the value to be controlled (in the specific case, each one of the four motions listed above), the controller that regulates the process acts, with programmable proportionality bands, with a power which is proportional to the linear value P of the deviation x, to its derivative D over time (speed), and to its integral I over time. This is particularly useful to avoid offsets between the glass pane 2 and the tape 1 and to avoid phenomena of instability, resonance, vibration and drift, which would make it impossible to perform the application process.

As illustrated, the movement axes which are mutually interpolated or interlocked and directly controlled are: the first axis A for the translational motion of the glass pane 2, the second axis B for the translational motion of the carriage 100, the third axis D for the rotation of the application head 200, and the advancement direction F of the tape 1 fed by the feeder means 203.

The following movement axes are instead controlled with feedback: the rotation axis C of the spool 301, the fourth translational axis E of the application head 200, the rotation axes of the reels 401*a* and 401*b*, the horizontal axis of movement of the input conveyance means 600 and the second direction H for adjusting the height of the scoring and/or cutting means.

In practice it has been demonstrated that the machine according to the invention achieves the proposed aim and objects.

The fact that the spool of tape is rigidly coupled, by means of the corresponding supporting means, to the carriage that supports the application head allows to arrange it, in each step of the application of the tape, as close as possible to said application head, preventing the generation of abnormal tensions on the tape.

The fact that the spool and the application head are rigidly coupled to the carriage in its translational motions but the spool is independent of the application head in its rotary and translational motions with respect to said carriage allows to eliminate inertia and vibration phenomena, allowing to apply precisely the tape 1 while maintaining a high production rate.

The machine according to the invention therefore allows to provide precisely comers and arc-like profiles of high quality.

The possibility to adjust the height of the scoring and/or cutting means allows to provide incisions or cuts of different depths depending on different operating requirements.

The invention is susceptible of numerous modifications and variations, all of which are within the scope of the appended claims.

Thus, for example, the mechanical solutions used to provide the various actuation means, for example of the die-cutter element or blade element, of the input conveyance means, of the means for moving the glass pane, for moving the carriage, for turning the head, for causing the advancement of the tape, etc, can be electrical, electrical-electronic, pneumatic, fluid-operated and/or combined. Likewise, the control means can be electronic or fluid-operated and/or combined.

Another variation of the machine according to the invention allows to work with spools in which the tape is wound so that its surface that is intended to be exposed to the outer side of the chamber of the double-glazing unit is visible or hidden.

The constructive details can be replaced with other technically equivalent ones. The materials and dimensions may be any according to requirements.

The disclosures in Italian Patent Application No. TV2004A000117 from which this application claims priority are incorporated herein by reference.

What is claimed is:

1. An automatic machine for applying a flexible tape on a substantially flat glass pane, comprising:

a machine body comprising a substantially vertical plane of arrangement, a first, horizontal movement axis and a second, substantially vertical movement axis, said first and second movement axes being perpendicular to each other and parallel to said plane of arrangement;

movement means provided on said machine body for moving along said first movement axis at least one flat glass pane that is arranged on said plane of arrangement;

a carriage that is movable along guiding means provided on said machine body parallel to said second, substantially vertical axis;

an application head for applying a flexible tape along a perimetric edge of said glass pane and which is rigidly coupled to said carriage for rotation about a third axis and for translational motion along a fourth axis, said third and fourth axes being substantially perpendicular to said plane of arrangement;

feeder means, rigidly coupled to said application head, for feeding said tape along an advancement direction thereof;

supporting means which are rigidly coupled to said carriage for supporting at least one storage spool for said tape, said supporting means supporting said storage spool so as to be rotatable about a longitudinal axis thereof, said supporting means and said application head being jointly movable with said carriage in its motion along said second movement axis, while said supporting means are coupled to said carriage so as to be independent of said application head both as regards rotary motion of the application head about said third axis and translational motion thereof along said fourth axis;

first actuation means for actuating said movement means to move the glass pane with a translational motion alone said first movement axis;

second actuation means for actuating said carriage with a translational motion along said second movement axis;

third actuation means for actuating said application head to rotate about said third axis;

fourth actuation means for actuating said tape feeder means, which are concatenated and controlled by a controller for synchronization and coordination of relative movements of said head and of said glass pane and of a motion for the feeding of said tape in order to apply the tape along the perimetric edge of said glass pane; and wherein said feeder means comprise two continuous belt conveyors, which are arranged one above the other along a longitudinal extension of said tape, are suitable to make contact with opposite faces the tape, and are associated with said head at an adjustable distance from each other, said fourth actuation means comprising motor means which are associated with said belt conveyors and are provided with corresponding transmission means interposed between the motor means and said belt conveyors.

2. The machine of claim 1, comprising fifth means for the rotary actuation of said spool about its longitudinal axis, which are associated with said supporting means and means for sensing the tension of the unwinding of said tape from said spool and/or the diameter of said spool, said fifth actuation means being reversible and being controlled by said controller in response to feedback signals received from said sensing means in order to unwind and rewind said tape.

3. The machine of claim 2, wherein said sensing means comprise a dancer arm, in which one end is articulated to said supporting means so that it can oscillate and the opposite end is provided with a cantilevered arm, which is suitable to make contact with the unwinding tape, and a potentiometer, having opposite ends thereof that are articulated respectively to said dancer arm and said supporting means.

4. The machine of claim 2, wherein said sensing means comprise at least one sensor element, which is suitable to sense the diameter of said spool.

5. The machine of claim 1, comprising sixth means, controlled by said controller, for the actuation of said head with a translational motion along said fourth axis.

6. The machine of claim 1, comprising means, rigidly associated with said carriage, for winding at least one film for protecting the side of said tape that is intended to be applied to said sheet.

7. The machine of claim 6, comprising seventh means for actuating said winding means controlled by said controller for winding or unwinding said film.

8. The machine of claim 7, comprising sensor means for detecting the tension of said protective film, which are suitable to send to said controller feedback signals of said seventh actuation means for stopping them in case of abnormal tension of said film.

9. The machine of claim 7, wherein said winding means comprise at least one reel, which is rotatably associated with said carriage, said seventh actuation means comprising motor means of the torque-control type for said reel.

10. The machine of claim 8, wherein said sensor means comprise probe means suitable to make contact with said film.

11. The machine of claim 1, wherein said application head comprises means for scoring and/or cutting said tape along a first direction which is substantially parallel to the width of the tape, means being provided for adjusting the height of said scoring and/or cutting means along a second direction, which is substantially parallel to the height of said tape, in order to adjust the depth of said scoring and/or said cut.

12. The machine of claim 11, wherein said cutting and/or scoring device means comprise a die-cutter element and/or a blade element, which is associated with said head so that it can perform a translational motion along said first direction, respective linear actuation means for said die-cutter element and/or said blade element being provided, said height adjustment means being suitable to adjust the height of said die-cutter element and of said blade element monolithically or independently of each other.

13. The machine of claim 11, wherein said height adjustment means comprise a slider element, which is associated so that it can slide along linear guiding means, which are rigidly coupled to said head and are substantially parallel to said second direction, means being provided for actuating the sliding of said slider element, said means being rigidly coupled to said head and being actuated by said controller.

14. The machine of claim 1, wherein said guiding means comprise rectilinear guides, which are arranged substantially parallel to said second axis, and in that said second actuation means comprise a screw, which is substantially parallel to said second axis and engages a lead screw formed monolithically with said carriage, said screw having an end which is associated with motor means of the reversible type, which are rigidly coupled to said machine body.

15. The machine of claim 2, wherein said supporting means comprise a bracket element, which is rigidly coupled to said carriage and with which said spool can be associated rotatably, said fifth actuation means comprising motor means of the reversible type, which are rigidly associated with said bracket element.

16. The machine of claim 1, wherein said application head comprises a supporting body, with which it is associated so that it can rotate about said third axis, said third actuation means comprising reversible motor means, which are rigidly associated with said supporting body.

17. The machine of claim 5, wherein said application head comprises a supporting body, with which it is associated so that it can rotate about said third axis, said third actuation means comprising reversible motor means, which are rigidly associated with said supporting body.

18. The machine of claim 17, wherein said supporting body is associated so that it can perform a translational motion along rectilinear guides, which are formed in said carriage and are substantially parallel to said fourth axis, said sixth actuation means comprising a screw, which is substantially parallel to said fourth axis and has an end which engages a lead screw formed monolithically with said supporting body and an opposite end which is coupled to reversible motor means rigidly coupled to said carriage.

19. The machine of claim 1, wherein each one of said continuous belt conveyors is provided with respective motor means.

20. The machine of claim 1, wherein said movement means comprise means for gripping said glass pane, which are rigidly associated with a slider which can perform a translational motion along linear guides, which are substantially parallel to said first axis and are formed in said machine body, said first actuation means comprising reversible motor means, which are associated with said slider with the interposition of means for converting the rotary motion into rectilinear motion.

21. The machine of claim 1, comprising input conveyance means and output conveyance means, which are arranged respectively upstream and downstream of said carriage with respect to the advancement direction of said glass pane along said first axis, which are associated with respective motorization means controlled by said controller.

22. The machine of claim 1, comprising input conveyance means and output conveyance means for conveying the at least one glass pane that rests thereon with a lower edge thereof, said input and output conveyance means being arranged respectively upstream and downstream of said carriage with respect to the advancement direction of said at least one glass pane along said first movement axis.

23. The machine of claim 1, wherein said carriage is constituted by a frame body on which said storage spool and said application head are coupled in a nearby configuration, said supporting means and said application head being jointly movable with said frame body while it moves along said second movement axis, and said supporting means are coupled to said frame body so as to be independent of said application head both as regards rotary motion of the application head about said third axis and translational motion thereof along said forth axis.

24. An automatic machine for applying a flexible tape on a substantially flat glass pane, comprising:

a machine body comprising a substantially vertical plane of arrangement, a first, horizontal movement axis and a second, substantially vertical movement axis, said first and second movement axes being perpendicular to each other and parallel to said plane of arrangement;

movement means provided on said machine body for moving along said first movement axis at least one flat glass pane that is arranged on said plane of arrangement;

a carriage that is movable along guiding means provided on said machine body parallel to said second, substantially vertical axis;

an application head for applying a flexible tape along a perimetric edge of said glass pane and which is rigidly coupled to said carriage for rotation about a third axis and for translational motion along a fourth axis, said third and fourth axes being substantially perpendicular to said plane of arrangement;

feeder means, rigidly coupled to said application head, for feeding said tape along an advancement direction thereof;

supporting means which are rigidly coupled to said carriage for supporting at least one storage spool for said tape, said supporting means supporting said storage spool so as to be rotatable about a longitudinal axis thereof, said supporting means and said application head being jointly movable with said carriage in its motion along said second movement axis, while said supporting means are coupled in said carriage so as to be independent of said application head both as regards rotary motion of the application head about said third axis and translational motion thereof along said fourth axis;

first actuation means for actuating said movement means to move the glass pane with a translation motion along said first movement axis;

second actuation means for actuating said carriage with a translational motion along said second movement axis;

third actuation means for actuating said application head to rotate about said third axis;

fourth actuation means for actuating said tape feeder means, which are concatenated and controlled by a controller for synchronization and coordination of relative movements of said head and of said glass pane and of a motion for the feeding of said tape in order to apply the tape along the perimetric edge of said glass pane; and wherein said feeder means comprise two continuous belt conveyors, which are arranged one above the other along a longitudinal extension of said tape, are suitable to make contact with opposite faces the tape, and are associated with said head at an adjustable distance from each other, and wherein said fourth actuation means comprise respective motor means provided for each one of said belt conveyors and corresponding transmission means interposed between said respective motor means and said belt conveyors.

25. The machine of claim 24, wherein said application head comprises means for scoring and/or cutting said tape along a first direction which is substantially parallel to the width of the tape, means being provided for adjusting the height of said scoring and/or cutting means along a second direction, which is substantially parallel to the height of said tape, in order to adjust the depth of said scoring and/or said cut.

26. The machine of claim 25, wherein said cutting and/or scoring device means comprise a die-cutter element and/or a blade element, which is associated with said head so that it can perform a translational motion along said first direction, respective linear actuation means for said die-cutter element and/or said blade element being provided, said height adjustment means being suitable to adjust the height of said die-cutter element and of said blade element monolithically or independently of each other.

27. The machine of claim 25, wherein said height adjustment means comprise a slider element, which is associated so that it can slide along linear guiding means, which are rigidly coupled to said head and are substantially parallel to said second direction, means being provided for actuating the sliding of said slider element, said means being rigidly coupled to said head and being actuated by said controller.

* * * * *